United States Patent [19]

Clark et al.

[11] Patent Number: 4,522,486

[45] Date of Patent: Jun. 11, 1985

[54] METHOD AND APPARATUS FOR ADAPTIVE COLLATION

[75] Inventors: Gary A. Clark, Longmont; Frederick W. Johnson, Boulder; Carl A. Queener, Longmont, all of Colo.

[73] Assignee: International Business Machines Corporation, Armonk, N.Y.

[21] Appl. No.: 850,175

[22] Filed: Nov. 10, 1977

[51] Int. Cl.[3] ..... G03G 15/00; B65H 39/11

[52] U.S. Cl. ..... 355/14 SH; 271/288; 271/4

[58] Field of Search ..... 271/173, 64, 9, 4, 3.1, 271/288, 289, 290, 291, 296, 297, 279, 287; 270/58; 355/3 SH, 24, 14 SH

[56] References Cited

U.S. PATENT DOCUMENTS

| | | | |
|---|---|---|---|
| Re. 27,976 | 4/1974 | Sahley . | |
| 4,012,032 | 3/1977 | Rogers | 271/173 X |
| 4,050,805 | 9/1977 | Hage | 271/163 X |
| 4,067,649 | 1/1978 | Hubbard et al. | 271/9 X |
| 4,114,871 | 9/1978 | Botte | 271/173 |
| 4,134,581 | 1/1979 | Johnson et al. . | |

OTHER PUBLICATIONS

Holzhauser et al., Research Disclosure, Sep. 1978, pp. 44–48, No. 17351.

Baumann, G. W. et al., "Maximizing Collator Reliability", *IBM Technical Disclosure Bulletin*, vol. 20, No. 4, Sep. 1977, p. 1298.

*Primary Examiner*—Bruce H. Stoner, Jr.

*Attorney, Agent, or Firm*—Gunter A. Hauptman; Earl C. Hancock

[57] ABSTRACT

The invention concerns a method and apparatus for operating a multibin sheet collator, particularly a copier/collator installation. Additional to the number of sets to be collated, the number of sheets contained in each set is entered into the collator logic. If this number of sheets in a set exceeds the capacity of a single collator bin, adjacent bins are grouped together and treated as one virtual bin with increased capacity, thus extending the collator usage. Sheets exceeding the total capacity of the collator can be fed into additional receptacles.

14 Claims, 25 Drawing Figures

PROGRAM OVERVIEW

REG D CONROL

MICROCODE LISTING

```
* BEGIN SEGMENT

    LR    DISPIN
    STR   REG D
    BZ    PP

    LB    OUTPUT1M
    TS    DISPO
    STB   OUTPUT1M
    B     QQ

PP  LB    OUTPUT1M
    TR    DISPO
    STO   OUTPUT1M

QQ  STB   OUTPUT1

* END SEGMENT
```

REG M CONTROL

MICROCODE LISTING

```
  * BEGIN SEGMENT
      LB   INPUT I
      TP   BIT 2
      BZ   G
      LB   BYTE I
      TS   BIT 2
      STB  BYTE I
      BNZ  H
      LR   REG D
      STR  REG M
      B    H
G     LB   BYTE I
      TR   BIT 2
      STB  BYTE I
H     LB   INPUT I
      TP   BIT 3
      BZ   J
      LB   BYTE I
      TS   BIT 3
      STB  BYTE I
      BNZ  K
      LR   REG M
      SR   REG H
      STR  REG M
      B    K
J     LB   BYTE I
      TR   BIT 3
      STB  BYTE I
K     LR   REG H
      SR   REG M
      LB   OUTPUT IM
      BNL  L
      TR   BIT I
      B    M
L     TS   BIT I
M     STB  OUTPUT IM
      STB  OUTPUT I
  * END SEGMENT
```

REG J CONTROL

MICROCODE LISTING

```
  * BEGIN SEGMENT

    LB    INPUT1
    TP    BIT4
    BZ    P

    LB    BYTE1
    TS    BIT4
    STB   BYTE1
    BNZ   Q

    CLA
    A1
    STR   REGJ
    B     Q
P   LB    BYTE1
    TR    BIT4
    STB   BYTE1
Q   LB    INPUT1
    TP    BIT5
    BZ    R

    LB    BYTE1
    TS    BIT5
    STB   BYTE5
    BNZ   S

    CLA
    STR   REGJ
    LR    REGN
    STR   REGX
    LIH   CONSTANT L
    TRA
    LIL   CONSTANT L
    STR   REGY
T   LRB   REGJ
    LR    REGX
    SR    REGY
    STR   REGX
    BH    T

    B     S
R   LB    BYTE1
    TR    BIT5
    STB   BYTE1
S   NOP

  * END SEGMENT
```

REG H CONTROL

MICROCODE LISTING

```
  * BEGIN SEGMENT

      LB    INPUT1
      TP    BIT6
      BZ    U
      LB    BYTE1
      TS    BIT6
      STB   BYTE1
      BNZ   V
      LI    CONSTANTK
      SR    REGM
      BL    QQ
      LI    CONSTANTK
      B     PP
QQ    LR    REGM
PP    STR   REGH
      STR   REGH OUT
      B     V
U     LB    BYTE1
      TR    BIT6
      STB   BYTE1
V     LB    INPUT1
      TP    BIT7
      BZ    W
      LB    BYTE1
      TS    BIT7
      STB   BYTE1
      BNZ   X
      LIH   CONSTANTK
      TRA
      LIL   CONSTANTK
      STR   REGX
      CLA
      STR   REGQ
```

REG H CONTROL continued

```
Z   LR    REGX
    SR    REGJ
    STR   REGX
    STR   REGH OUT
    BNL   AA

    B     X

AA  LRB   REGQ
    B     Z

W   LB    BYTE1
    TR    BIT7
    STB   BYTE1

X   LR    REGQ
    SR    REGM
    BL    RR

    LR    REGQ
    B     SS

RR  LR    REGM
    STR   REGH
    STR   REGH OUT

  * END SEGMENT
```

REG N CONTROL

MICROCODE LISTING

```
  * BEGIN SEGMENT
      LB   INPUT I
      TP   BIT 0
      BZ   A
      LB   BYTE I
      TS   BIT 0
      STB  BYTE I
      BNZ  B
      LR   REG D
      STR  REG N
      B    B
A     LB   BYTE I
      TR   BIT 0
      STB  BYTE I
B     LB   INPUT I
      TP   BIT I
      BZ   C
      LB   BYTE I
      TS   BIT I
      STB  BYTE I
      BNZ  D
      LR   REG N
      SR   REG H
      STR  REG N
      B    D
C     LB   BYTE I
      TR   BIT I
      STB  BYTE I
D     LIH  L
      TRA
      LIL  L
      SR   REG N
      LB   OUTPUT IM
      BNL  E
      TR   BIT 0
      B    F
E     TS   BIT 0
F     STB  OUTPUT IM
      STB  OUTPUT I
  * END SEGMENT
```

FIG. 6H
VIRTUAL COLLATION CONTROL

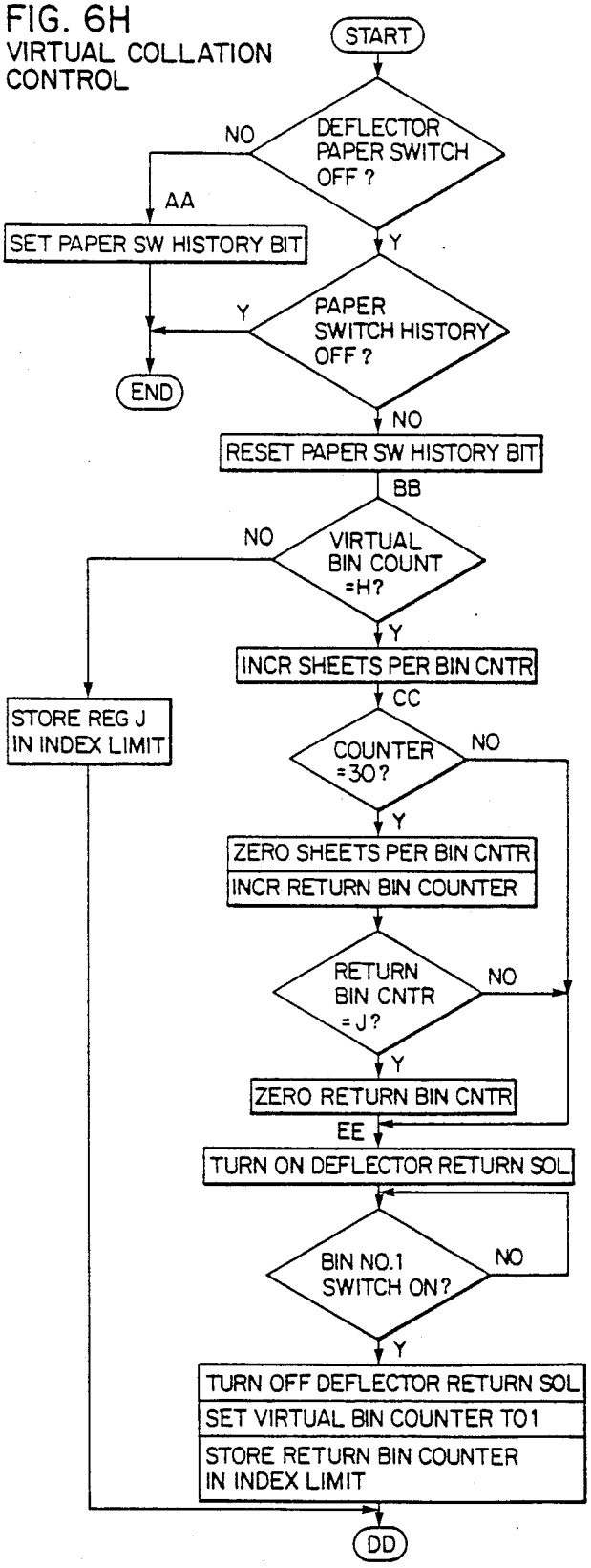

MICROCODE LISTING

```
  * BEGIN SEGMENT

      LB    INPUT2
      TP    BITO
      BNZ   AA

      LB    BYTE2
      TP    BITO
      BZ    JJ

      TR    BITO
      STB   BYTE2
      B     BB

AA    LB    BYTE2
      TS    BITO
      STB   BYTE2
      B     JJ

BB    LB    REGH
      CB    VBINCNT
      BE    CC

      LB    REGJ
      STB   INDEXLIM
      LB    VBINCNT
      AI
      STB   VBINCNT
      B     DD

CC    LB    SHEETCNT
      AI
      STB   SHEETCNT
      CI    D'30'(decimal)
      BNE   EE

      CLA
      STB   SHEETCNT
      LB    RETBINCT
      AI
      STB   RETBINCT
      SB    REGJ
      BNE   EE

      CLA
      STB   RETBINCT

EE    LB    OUTPUT1M
      TS    BIT3
      STB   OUTPUT1M
      STB   OUTPUT1
```

FIG. 6J
VIRTUAL COLLATION
CONTROL continued

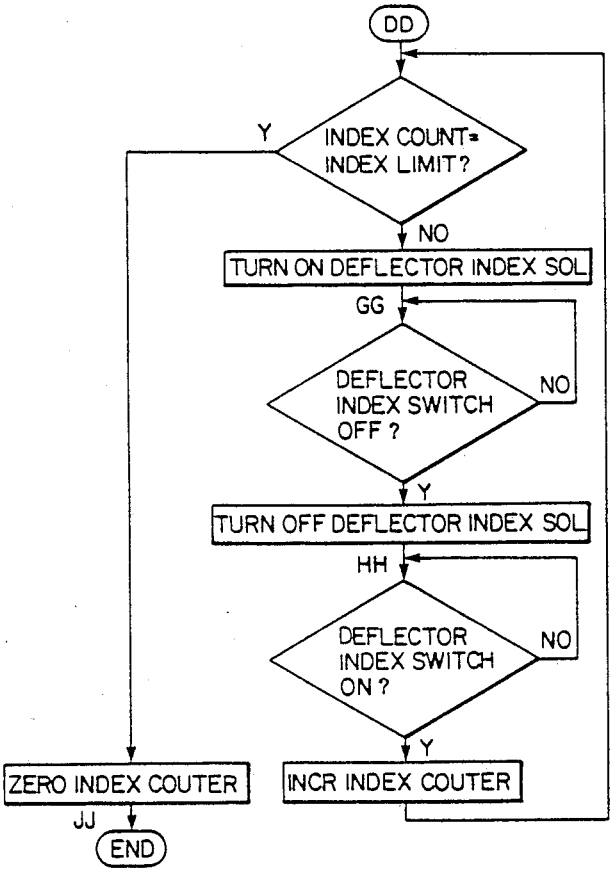

```
FF LB    INPUT2
   TP    BIT2
   BZ    FF
   LB    OUTPUT1M
   TR    BIT3
   STB   OUTPUT1M
   STB   OUTPUT1
   LI    1
   STB   VBINCNT
   LB    RETBINCNT
   STB   INDEXLIM
DD LB    INDEXCNT
   CI    INDEXLIM
   BE    KK
   LB    OUTPUT1M
   TS    BIT2
   STB   OUTPUT1M
   STB   OUTPUT1
GG LB    INPUT2
   TP    BIT1
   BNZ   GG
   LB    OUTPUT1M
   TR    BIT2
   STB   OUTPUT1M
   STB   OUTPUT1
HH LB    INPUT2
   TP    BIT1
   BZ    HH
   LB    INDEXCNT
   A1
   STB   INDEXCNT
   B     DD
KK CLA
   STB   INDEXCNT
JJ NOP
 * END SEGMENT
```

DUPLEX TRAY BYPASS

MICROCODE LISTING

```
* BEGIN SEGMENT

    LR    REGD
    SR    REGM
    BNE   KK
    LB    BYTE2
    TS    BIT1
    STB   BYTE2
    BNZ   MM
    B     LL
KK  LB    BYTE2
    TR    BIT1
    STB   BYTE2
    B     MM
    LRB   REGP
    LB    INPUT2
    TP    BIT3
    BZ    MM
    LR    REGN
    TP    BITO
    BZ    MM
    S1
    SR    REGP
    BNE   MM
    LB    INPUT2
    TP    BIT4
    BE    LL
    LB    OUTPUT1M
    TS    BIT5
    STB   OUTPUT1M
    STB   OUTPUT1
    B     MM
LL  LB    BYTE2
    TS    BIT2
    STB   BYTE2
MM  NOP

* END SEGMENT
```

DUPLEX TRAY FLUSH

MICROCODE LISTING

```
 * BEGIN SEGMENT

    LB    BYTE2
    TP    BIT2
    BZ    NN

    LR    REGN
    SR    REGP
    BNE   NN

    LB    BYTE2
    TR    BIT2
    STB   BYTE2
    LB    OUTPUT1M
    TS    BIT6
    STB   OUTPUT1
    TR    BIT6
    STB   OUTPUT1

NN  NOP

 * END SEGMENT
```

METHOD AND APPARATUS FOR ADAPTIVE COLLATION

CROSS-REFERENCES

The following commonly assigned U.S. patent and co-pending U.S. patent applications are incorporated by reference:

Ser. No. 752,777, filed Dec. 20, 1976, U.S. Pat. No. 4,134,581, entitled "Virtual Bin Collator Control";

Ser. No. 768,651, filed Feb. 14, 1977, entitled "Copy Production Machines";

Ser. No. 729,453, filed Oct. 4, 1976, U.S. Pat. No. 4,123,155, entitled "Copy Production Machine Having a Duplex Copy Mode";

U.S. Pat. No. 4,026,543, issued May 31, 1977, entitled "Document Article Handling Control";

Ser. No. 850,168, filed Nov. 10, 1977, U.S. Pat. No. 4,200,386, entitled "Copier/Collator with Extended Collate Functions".

BACKGROUND OF THE INVENTION

The invention relates to the field of collator apparatus, i.e., sorting devices for sheet material as used extensively to produce multiple collated sets of multipage documents which have been printed or copied.

Various collators or sorting apparatus are known in the art. Cross-referenced patent application Ser. No. 752,777, filed Dec. 20, 1976, entitled "Virtual Bin Collator Control" describes a method and apparatus for controlling a multibin sheet collator and contains a discussion of the prior art relating to such apparatus.

A copy production machine suitable to operate either in a simplex mode, wherein each copy has an image only on one side, or in a duplex mode, wherein copies have images on both sides, is described in cross-referenced patent application Ser. No. 729,453, filed Oct. 4, 1976, entitled "Copy Production Machine Having a Duplex Copy Mode".

A copy production machine having a print mode under automatic control interruptible by a copy mode is disclosed in cross-referenced patent application Ser. No. 768,651, filed Feb. 14, 1977, and entitled "Copy Production Machines". This copy production machine can be connected with a data processing system providing one input source for the information to be printed.

A given collator, e.g., as described in one of the above-referenced patent applications, satisfies a very large number of customer requirements, but obviously reaches a limit as soon as documents have to be collated, in which the number of sheets exceeds the capacity of a single collator receptacle. The collation job can be executed in two or more steps, of course, but this requires manual interaction by the operator who has to merge the collated parts of the sets. Another limitation is reached as soon as the number of sets to be collated exceeds the number of receptacles in the collator. Again, by interaction of the operator, this problem can be solved by execution of the collation job in different steps. But this operator interaction is costly and may introduce mistakes by wrongly collating sets.

It is one object of the present invention to improve the performance and capabilities of collators.

Another object is to enable execution of collation jobs which exceed the capacity of a given collator, thus providing a more efficient use of said given collator.

A further object of the invention consists in providing optimum adaption of a collator to different collation jobs.

A particular object of the invention is to enable execution of collation jobs exceeding the capacity of each single collator bin.

Another particular object is to enable execution of collation jobs exceeding the total capacity of the collator.

A further object is to provide a versatile and adaptive copier/collator combination, obtaining the aforementioned objects.

An additional object is to extend the automatic operation during duplex copying of a copier combination.

Generally speaking, a basic object of the present invention is to provide a method and an apparatus for controlling the operation of a sheet collator utilizing information as to the number of sets to be collated and the number of sheets in each set, to achieve expanded collation capacity for a given collator.

SUMMARY OF THE INVENTION

The invention achieves these and other objects by a new method for controlling the operation of a sheet collator or copier and control circuitry performing this method.

The definitions in Table I will be used throughout the specification:

TABLE I

| Letter | Definition |
|---|---|
| J | Number of actual bins per single virtual bin |
| K | Total number of actual bins in collator |
| L | Sheet capacity of single actual bin |
| M | Copies desired per original/number of sets to be collated |
| N | Number of originals/number of sheets in set |
| H | Number of accessed virtual bins |
| Q | Number of virtual bins available |
| R | Number of actual bins not used |

The example below illustrates the concept of processing a set of originally supplied document sheets ("originals") to supply multiple sets of copy sheets ("copies" or "sheets").

A given sheet collator is assumed to have K actual bins, each of which has a capacity of L sheets. The operator inputs the number M of sets to be collated and, as a second entry under certain conditions, inputs the number N of sheets in each set.

If the number M of sets does not exceed the number K of acutal bins of the collator and, at the same time, the number N of sheets in a set does not exceed the sheet capacity L of an actual bin, the collation job can be executed in a conventional way.

If the number N of sheets in a set exceeds the sheet capacity L of an actual bin, so-called "virtual bins" are formed from preferably adjacent actual bins in the collator. Each virtual bin is of a sheet capacity equal to L times the number J of actual bins in a virtual bin. Thus, if a virtual bin comprises J actual bins, the sheet capacity of the virtual bin is J·L. (For example, if $J=1$ then $H=K$, one virtual bin comprising one actual bin.) The total number K of actual bins in the collator is partitioned as $K=(H \cdot J)+R$, wherein H·J is the number of actual bins used and R is the remaining number of actual bins not used. This partitioning is executed by logic circuits provided with the collator. After the virtual bins have been established, filling of the bins is controlled to enable the collation of one complete set in each virtual bin, i.e., in adjacent actual bins under the given conditions.

If the number M of sets to be collated exceeds the number H of virtual bins or the number K of actual bins, the logic circuits of the collator provide that the excessive sheets are stacked in an overflow tray, e.g., an internal auxiliary tray. After the first H or K sheets have been collated into the virtual or actual bins, respectively, the excess sheets are fed into said internal auxiliary tray. After removal of the collated sets from the collator, the uncollated sheets from the tray are collated, this function being initiated by an operator controlled start signal or automatically upon removal of the collated sheets from the collator.

Alternatively, the excess sheets in the above example can be fed into an external exit tray and stacked therein. A signal requests the operator to remove the sheets stacked in this exit tray and reinsert them into a collator input receptacle for a second run, after the collator bins have been emptied.

The invention solves an additional problem occurring when a copier is in the duplex mode and an odd number of originals are to be copied. Then the last copy will be a simplex copy, bearing an image only on one side. It is conventional to feed this last simplex copy into the copier's duplex tray, although there is no need to do it, and to produce a "copy" on the back side in order to feed it into an exit tray or a collator in proper sheet sequence. The only other conventional way is to remove this last copy manually from the exit tray and/or to manually collate the last copy sheets to produce a proper page sequence for each set.

The solution of the invention uses the additional information obtained from the entered number N of originals. Therefore, the machine logic "knows" when the last copy is produced and effects the automatic feeding of this last copy into the collator or the exit pocket with or without using the duplex tray. Additionally, a turnover mechanism may have to be deactivated if this last copy is fed into a collator, as detailed in the following specification.

The foregoing and other features of the invention as well as its advantages and applications will be apparent from the following detailed description of the preferred embodiment which is illustrated in the accompanying drawings.

BRIEF DESCRIPTION OF THE DRAWINGS

FIG. 6A to 6H and 6J to 6L represent overview and segments of flow charts and code listings for the control of the processor.

DESCRIPTION OF THE PREFERRED EMBODIMENT

FIGS. 1A–1B

Figure 1A:
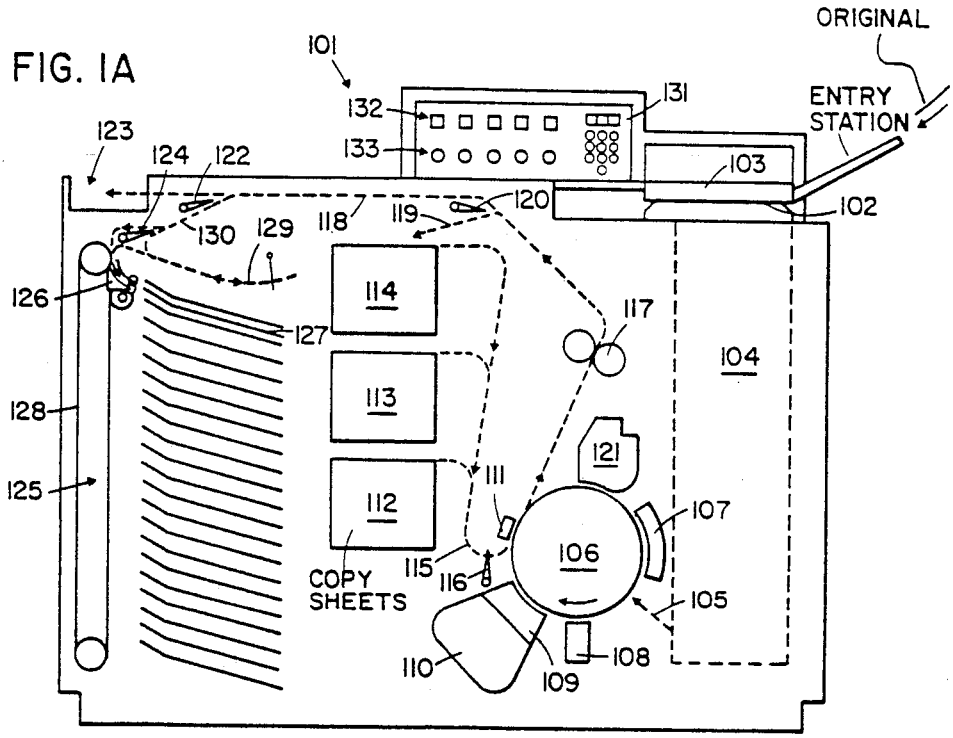
FIG. 1A shows a schematic view of a copier with an integrated multibin collator.

FIG. 1A shows a preferred embodiment of the invention in the form of a xerographic copier or duplicator with an integrated multibin collator. It shall be kept in mind that this embodiment is of an exemplary character. The copy production machine could be replaced by an impact or nonimpact printer; the collator could be a stand-alone collator of any conventional design capable of performing the function described in this specification.

Before proceeding further with the description of the embodiment of the invention, the operation of the copier/collator 101 shown schematically in FIG. 1A will be briefly explained. An original (not shown) has to be placed on document glass 102 which can be done either manually or via a semiautomatic or automatic document feed 103. Optical system 104 generates an optical image which, as indicated by arrow 105, is projected onto the photoconductor drum 106 rotating in the direction of the shown arrow. Before the image is projected, a uniform electrostatic charge is applied by charge corona 107 onto the photoconductor. The optical image projected onto the photoconductor alters the charge distribution, i.e., exposes the photoconductor surface. The now existing charge pattern is termed a "latent image" on the photoconductor. Erase arrangement 108 discharges the photoconductor in the nonimage areas.

The following station in the xerographic process is the developing station 109 which receives toner or ink from a supply 110 with an electrostatic charge, the polarity of which is opposite to that of the charged areas of the photoconductive surface. Accordingly, the toner particles adhere electrostatically only to the charges, but not to the discharged, photoconductor areas. Hence, after leaving the developing station 109, the photoconductor on drum 106 has a toned image corresponding to the dark and light areas of the original document. This toner image on the photoconductor is now transported to transfer station 111. Paper is fed from one of the three drawers 112, 113, or 114 along paper path 115 to synchronizing gate 116. In the transfer station 111, the paper is brought in contact with, or very close to, the photoconductor surface of drum 106 and is brought under the influence of the electrostatic field of a corona. This field transfers the toner image onto the paper after which the sheet bearing the toner image is stripped from the photoconductor. The adhering toner image is fused or fixed to the paper surface by fuser rolls 117. The produced copy, directed by duplex vane 120, either exits the copier portion of the copier/-collator 101 via paper exit path 118 or is fed into duplex tray 114.

Returning to photoconductor drum 106, there is still a certain amount of residual toner left on the photoconductor after the transfer to the paper sheet. Accordingly, cleaning station 121 is provided for removing the residual toner and cleaning the image area to prepare it for receiving the next charge by charge corona 107. This cycle then repeats in the way described above.

When producing duplex copies, i.e. copies bearing images on both sides of the paper sheet, duplex vane 120 is actuated after the first side is copied and feeds this "half copy" into duplex tray 114. As soon as the image to be printed on the other side of the duplex copy is available on the photoconductor drum 106, the "half copy" is picked up from duplex tray 114 and fed into paper path 115 to receive the second toner image.

Subsequently, the second image is also fixed to the paper sheet by fuser rolls 117, and the copy is exited via paper exit path 118 by appropriate selection of duplex vane 120. The copy, now traveling along paper exit path 118, may be deflected by exit vane 122 either into exit pocket 123 or towards collator 125. Activation of exit vane 122 deflects the copy such that it travels along collator paper path 130 until it reaches transport belt 128. Movable deflector 126 traveling along transport belt 128 is positioned adjacent the selected collator bin 127 and feeds the incoming sheet into the bin.

A sheet inverting or turnover mechanism 129 has to be provided as soon as duplex copies, i.e., copies bearing images on both their sides, are to be collated. The reason for this is that in the copier/collator shown in FIG. 1A the page imaged last is fed into the collator face down. That means a copy bearing the images of page 1 and page 2 would be collated with facing page 2 down. The next duplex copy, bearing images of pages 3 and 4 would be stacked upon that first copy with page 4 facing down. The same way, the following copy would be stacked with page 6 facing down. When removing this stack out of one of the collator bins, the page sequence would look: page 2, page 1; page 4, page 3; page 6, page 5; which is not very useful because it has to be rearranged. Turnover mechanism 129 simply inverts each duplex copy entering collator 125. Thus, the stack described above, because of the inversion of each separate sheet, would look: page 1, page 2; page 3, page 4; page 5, page 6 on three copy sheets. From this example it should be understood that turnover vane 124 has to feed all duplex copies via turnover mechanism 129 towards collator 125. A suitable turnover mechanism is described in IBM TECHNICAL DISCLOSURE BULLETIN, Vol. 18, No. 1, June 1975, page 40, entitled "Sheet Turnover Device", by S. R. Harding.

An operator panel 131 includes an input area 133 for operator inputs, such as number of copies to be produced, number of sheets in one original set, collator selection, light/dark copy, etc. Furthermore, it comprises a message display area 132 including several digits for displaying numbers selected and other information concerning the dialogue between operator and machine.

The integrated collator 125 comprises several switches and solenoids which are not shown in FIG. 1A for the purpose of simplification. Examples may be found in the above cross-referenced U.S. Pat. No. 4,134,581, patent application Ser. No. 752,777, filed Dec. 20, 1976, and the above cross-referenced U.S. Pat. No. 4,026,543.

A deflector paper switch (not shown) is in the paper path of movable deflector 126. It delivers a signal when a sheet is fed through deflector 126 into a bin 127. Release of the deflector paper switch indicates that a sheet has been fed into a bin 127.

A deflector index solenoid (not shown) serves to index or step the deflector to the next successive bin 127 below the preceeding one. The first bin 127 is situated at the top of the bin assembly.

A deflector index switch (not shown) is always actuated when deflector 126 is opposite any bin 127. It turns off when deflector 126 is between bins, turns on as deflector 126 reaches the next bin, and remains on until deflector 126 is indexed again.

A deflector return solenoid (not shown) causes deflector 126 to return to the first bin when energized. A bin number one switch (not shown) turns on as soon as deflector 126 is at the first bin. The switches and solenoids above are implemented without difficulty by someone skilled in the art.

Figure 1B:
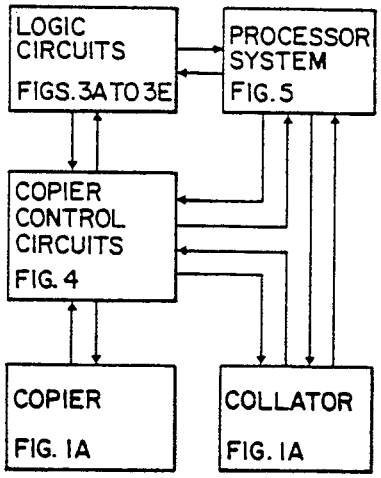
FIG. 1B illustrates the general configuration of the copier/collator control.

FIG. 1B is a block diagram showing the general functional configuration of the copier/collator of FIG. 1A. The copier portion of this copier/collator is directly controlled by the copier control circuits shown in more detail in FIG. 4. Moreover, the copier control circuits are connected and controlled by logic circuits (detailed in FIGS. 3A to 3E) which in turn cooperate with a processor system shown in detail in FIG. 5. This processor system controls the collator portion of the copier/collator and is connected with the copier control circuits and logic circuits. A further link connects the collator with the copier control circuits. The shown functional implementation is to be understood as exemplary. The complete system of FIGS. 3–5 may be replaced by one or more program controlled processor systems or completely implemented in hardware logic without departing from the invention.

The remaining figures show a detailed implementation of the method of the invention and circuits enabling the execution of this method.

FIGS. 2A–2C

Figure 2A:
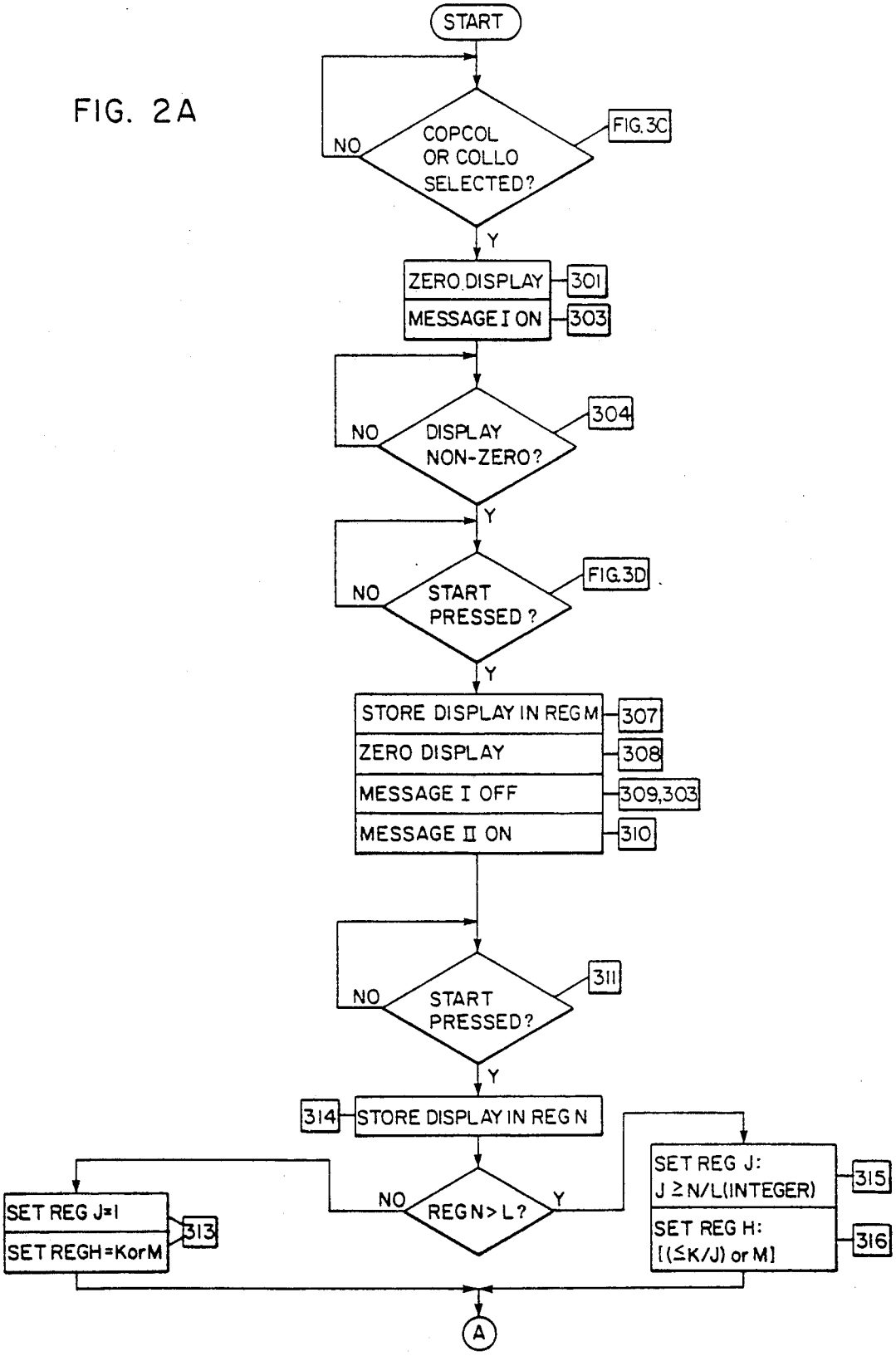
FIGS. 2A to 2C represent a flow chart for the execution of the method of operation of the invention.
Figure 2B:
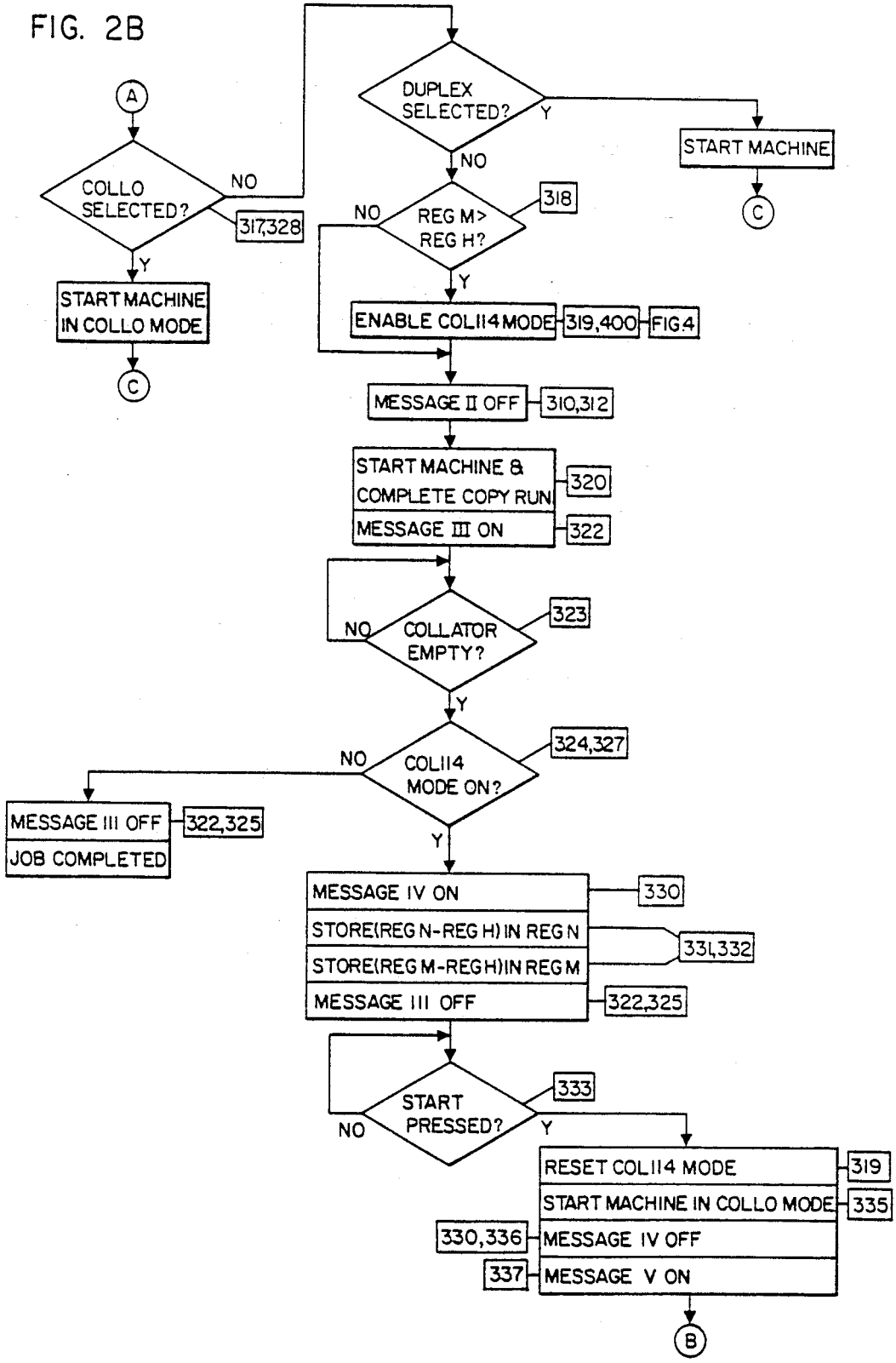
Figure 2C:
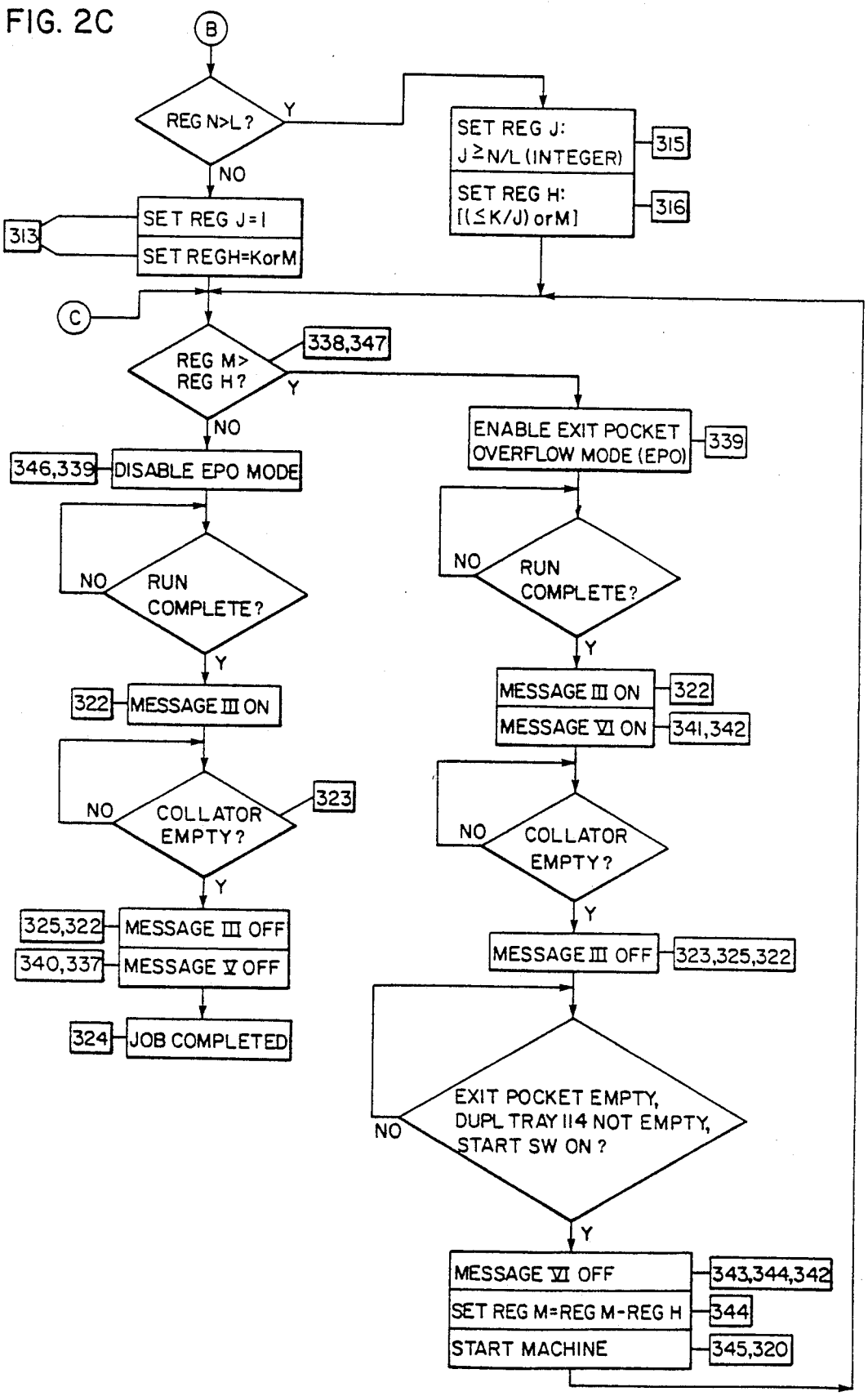

FIGS. 2A to 2C are a flow diagram implementing the method of the invention using the copier/collator installation generally depicted in FIG. 1A. The letters J, K, L, M, N, and H as defined above have been used.

FIGS. 2A to 2C will be referred to below with respect to FIGS. 3A to 3F which show the logic hardware circuits controlling the operation of the copier/collator of FIG. 1A. The numbers in the small rectangles beside the logic blocks of FIGS. 2A to 2C refer to the parts of FIGS. 3A to 3F. Therefore, the discussion of the method of FIGS. 2A to 2C encompasses the working of the circuits of FIGS. 3A to 3F.

FIGS. 3A–3F

Figure 3A:
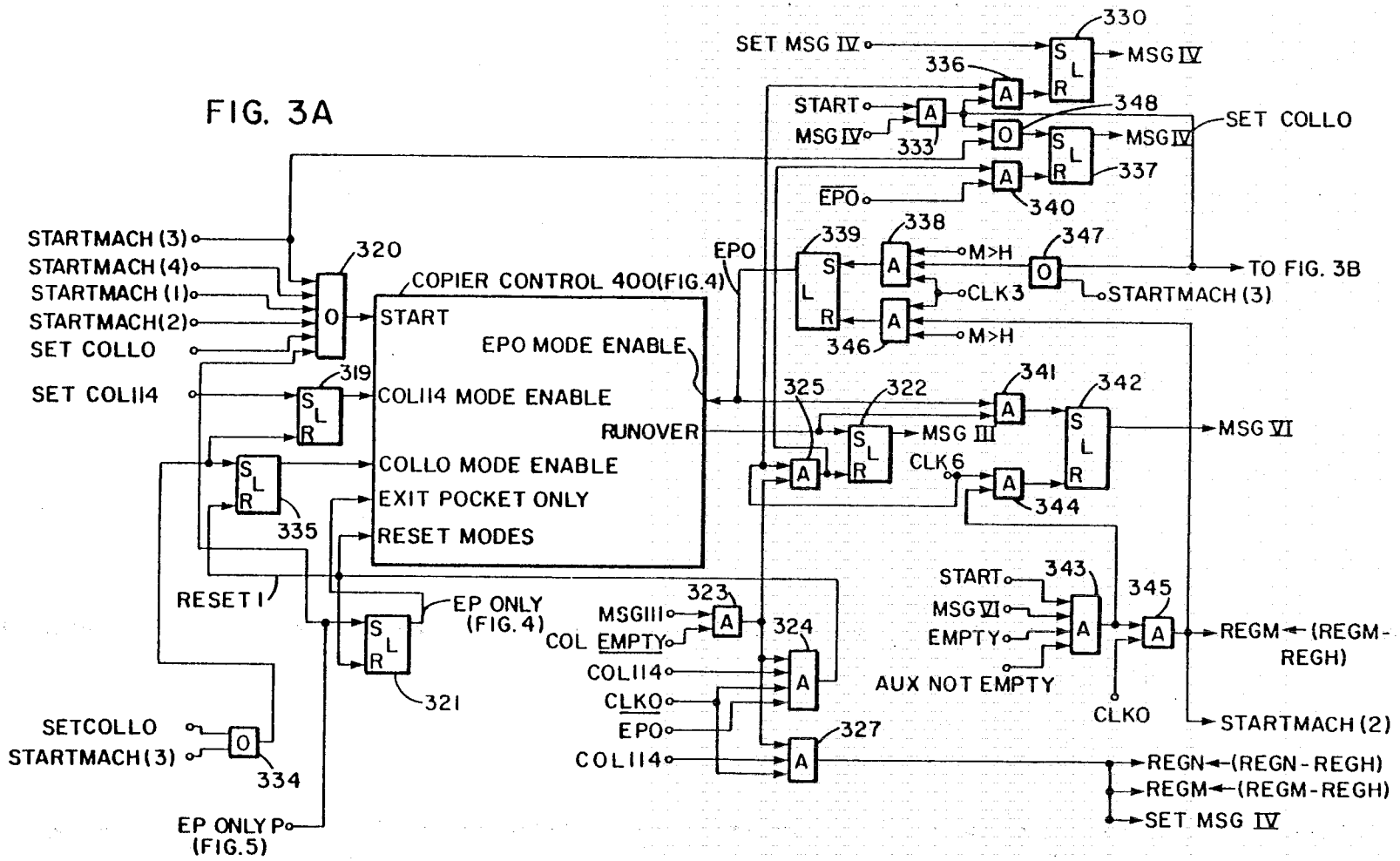
FIGS. 3A to 3F show the logic circuits controlling the operation of the copier/collator.
Figure 3B:
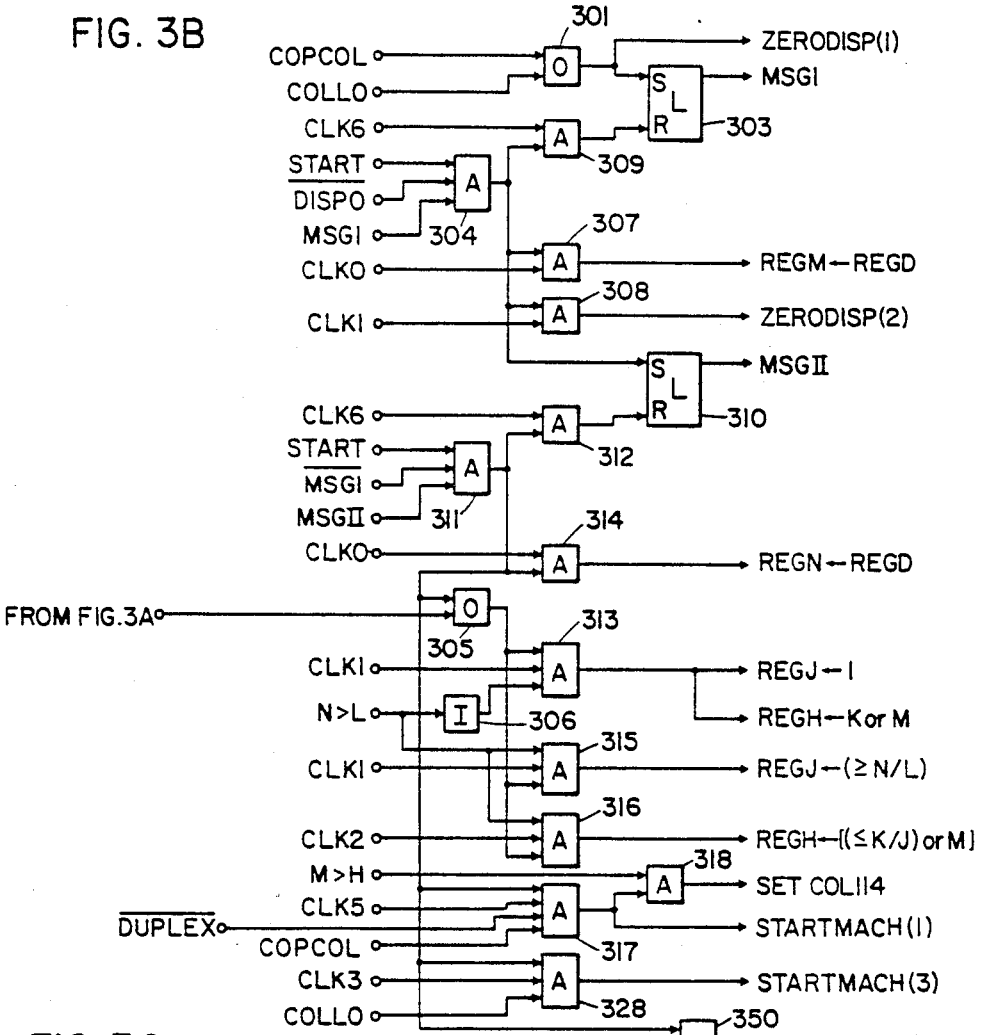
Figure 3C:
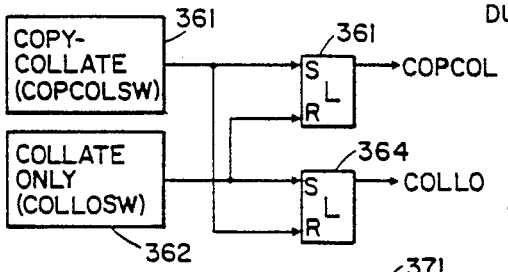
Figure 3D:
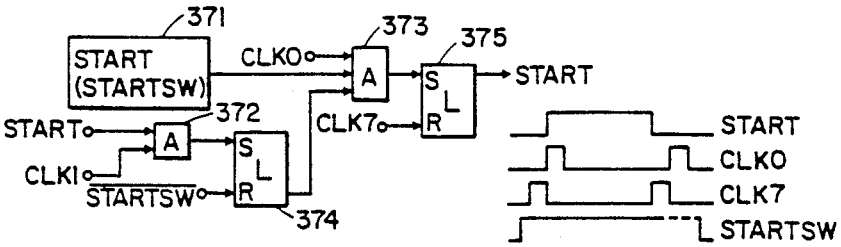
Figure 3E:
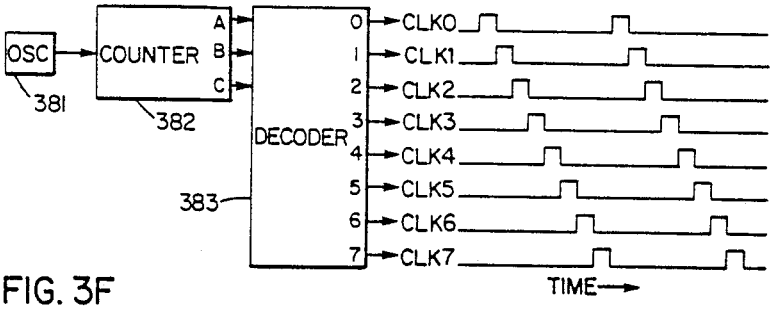
Figure 3F:
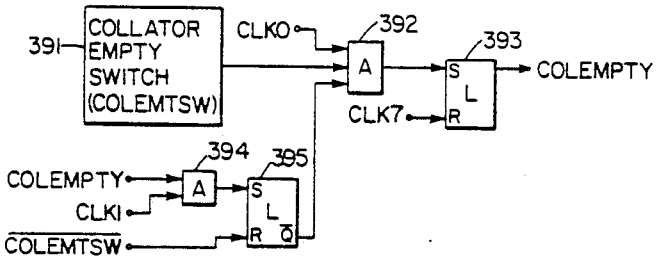

The logic circuits shown in FIGS. 3A to 3D, and FIG. 3F are controlled by repeating clock signals derived from a clock shown in FIG. 3E. In FIG. 3E, an oscillator 381 drives a three-bit binary counter 382 which in turn is connected to a 3-to-8 line binary decoder 383. The output signals of this decoder 383 are labeled CLK0 to CLK7. Their relative positions as a function of time are shown by waveforms in FIG. 3E.

FIG. 2A

The operator, by pressing the appropriate buttons in the input area 133 of operator panel 131 (FIG. 1A), i.e. pressing either button 361 or 362 shown in FIG. 3C, selects the basic mode the copier/collator shall operate in. He either chooses the "Copy and Collate" mode, hereinbelow and in the drawings labeled COPCOL or he selects, by pressing button 362, the "Collate Only" mode of the copier/collator, hereinbelow named COLLO. As shown in FIG. 3C, both buttons 361 and 362 define inputs setting latches 363 and 364 respectively which in turn deliver output signals labeled COPCOL and COLLO. These switches and modes appear, with others explained hereinafter, in Tables II and III.

TABLE II

| Switch | FIG. | Function |
|---|---|---|
| COPCOLSW | 3C | Select Copy-Collate Mode |
| COLLOSW | 3C | Select Collate Only Mode |
| STARTSW | 3D | Start Copier |
| COLEMTSW | 3F | Collator Empty |
| EP EMPTY | 3A | Exit Pocket Empty |
| AUX NOT EMPTY | 3A | Auxiliary Tray Not Empty |
| STOP/CLEAR | 4 | Stop Job/Clear Display |
| RESET 1 | 4 | Reset All Functions |
| BIN 1 SW | 5 | Deflector at First Bin |
| INDEXSW | 5 | Deflector at Any Bin |
| DEFPAPSW | 5 | Sheet in Deflector |

TABLE III

| Mode | Definition |
|---|---|
| COPCOL | Copy and Collate |
| COLLO | Collate Only |
| SIMPLEX | Copy One Side |
| DUPLEX | Copy Two Sides |
| COL114 | Auxiliary Tray Overflow |
| EPO | Exit Pocket Overflow |

These two output signals COPCOL and COLLO enter OR gate 301 (FIG. 3B), whose output signal ZERODISP(1) zeroes the number displayed in message display area 132 through OR gate 403 (FIG. 4) and effects setting of latch 303.

Table IV lists the functions of this latch and others to be explained hereinafter.

TABLE IV

| Latch | FIG. | Function |
|---|---|---|
| 303 | 3B | MSGI On |
| 310 | 3B | MSGII On |
| 319 | 3A | COL114 Enable |
| 321 | 3A | Exit Pocket Only |
| 322 | 3A | MSGIII On |
| 330 | 3A | MSGIV On |
| 337 | 3A | MSGV On |
| 342 | 3A | MSGVI On |
| 363 | 3C | COPCOL Mode On |
| 364 | 3C | COLLO Mode On |
| 371 | 3D | Start Signal |

By output of latch 303, Message I is displayed at the operator panel 131 in the message display area 132. Message I asks the operator for the number M of copies per original (number of collated sets) he wants to have produced if he selected the COPCOL mode. He is asked for the number M of sets he wants to have collated, if he preselected the COLLO mode of the copier/collator. For both purposes, the display area 132 may display for example a message light saying "Copies/Sets?". Alternatively, symbols may be used to make the machine question understood even by someone not using the English language. Table V defines this message and others which will be explained hereinafter.

TABLE V

| Message | Definition |
|---|---|
| MSGI | Enter M |
| MSGII | Enter N |
| MSGIII | Empty Collator |
| MSGIV | Overflow |
| MSGV | Collate Only |
| MSGVI | Transfer Copies |

FIG. 3D shows the start circuit with the start pushbutton 371 located in the input area 133 of the operator panel 131. The start switch 371 controls latch 375 via AND gate 373 which is enabled by clock signal CLK0. The output signal of latch 375 is the signal START and consists of a single pulse which is set with the output of AND gate 373 at CLK0 and reset at time CLK7. AND gates 372 and 373 and latch 374 ensure that this pulse is generated only once per depression of the start switch. This is accomplished because the output of AND gate 372 sets latch 374 when the START signal and CLK1 are present. The shown inverted output of latch 374 disables AND gate 373 to prevent further generation of START pulses until STARTSW is released, resetting latch 374 and enabling AND gate 373.

Figure 4:
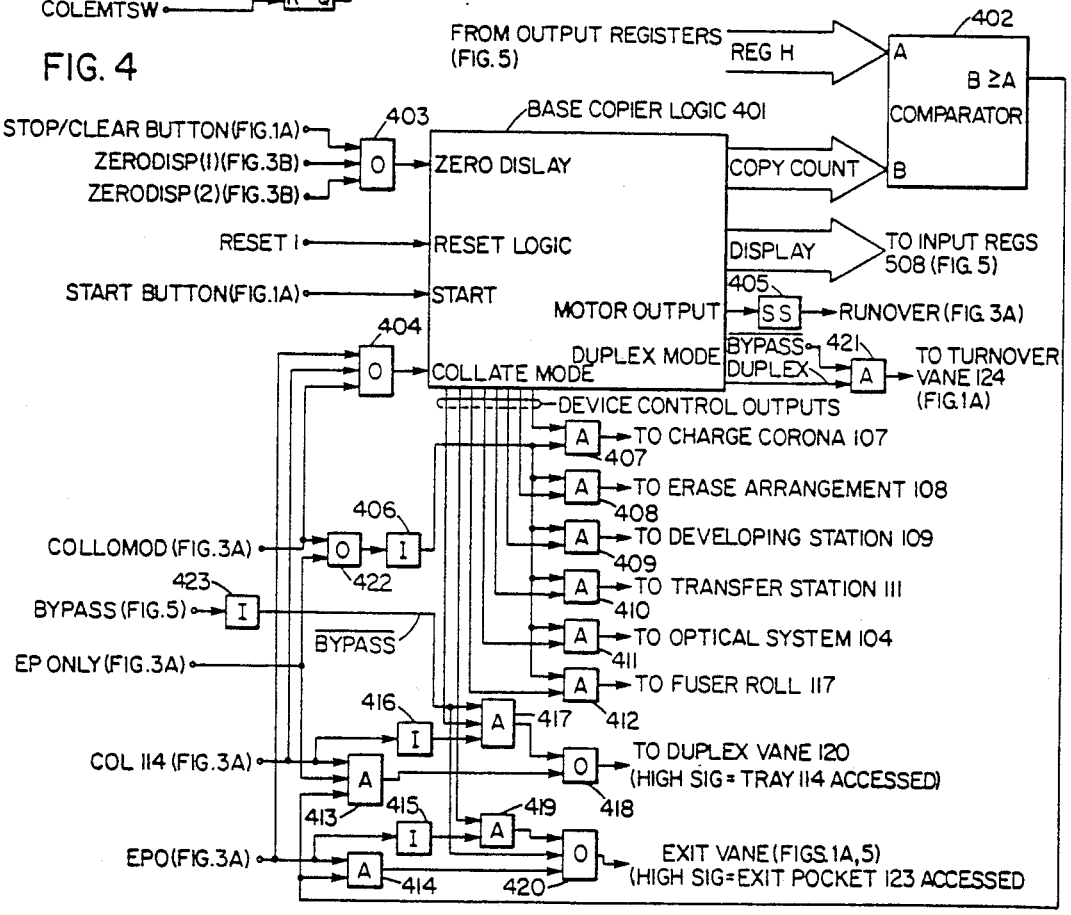
FIG. 4 illustrates the control circuit of the copier.
Figure 5:
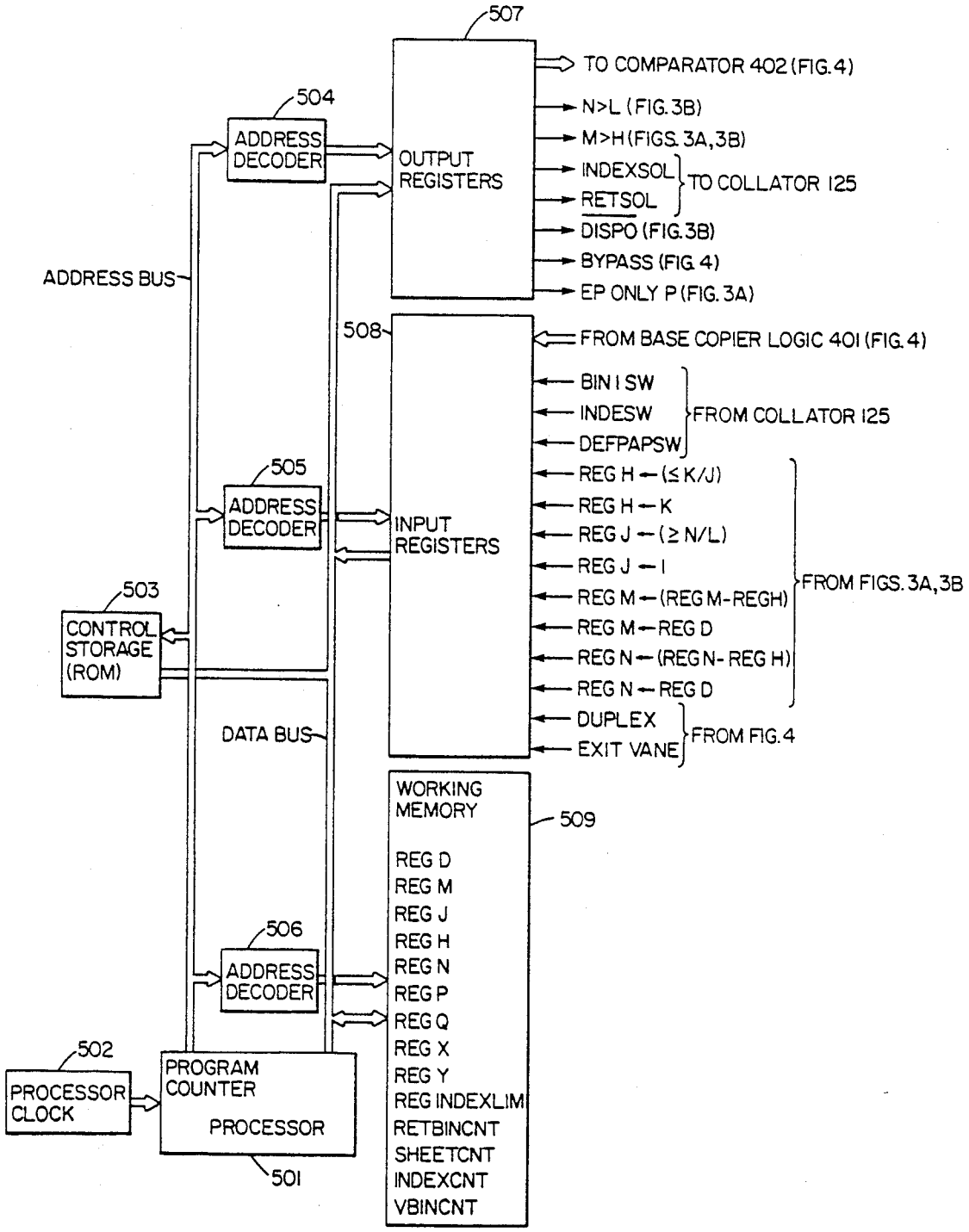
FIG. 5 shows a processor adapted to assist the logic circuits by performing necessary calculation functions.

Before the operator presses the start signal, he or she must have previously entered into the numerical display the number M of copies to be made or sets to be collated using the existing data entry keys and display means of control panel 131. The number M selected by the operator through keying it into the data dispaly of input area 132 of the operator panel 131 is continuously monitored by the processor system and stored in its working memory 509 display register REG D (FIG. 5B). Hereafter, all registers referred to without further designation are located in the working memory 509 of the processor system shown in FIG. 5 and described hereinbelow. If the content of register REG D is not zero, the processor control program will set an output from output registers 507, indicating that the display is not zero. Otherwise the $\overline{\text{DISPO}}$ output will be reset (low). In FIG. 3B, if no selection of M has been made, the start signal is disabled at AND gate 304 by the low $\overline{\text{DISPO}}$ signal until such time that the operator enters a number into the display and then presses start button 371. At this time the signals $\overline{\text{DISPO}}$ and START described above are produced. This executes the following steps. First, the signal REG M←REG D from AND gate 307 causes the processor to store the number in display register REG D in register REG M shown in FIG. 5. This signal is generated when AND gate 307 (FIG. 3B) is enabled by clock signal CLK0. The other input of AND gate 307 is enabled by the output of AND gate 304 which receives as input the signals START, $\overline{\text{DISPO}}$ from the processor system as a function of the value of the copier display which is stored in register REG D (FIG. 5), and MSGI from latch 303. The output of AND gate 304 also sets latch 310 to cause a signal MSGII indicating a new message to the operator. At time CLK1, AND gate 308 is enabled which zeroes the display in the base copier logic 401 (FIG. 4) with output signal ZERODISP(2) through OR gate 403 (FIG. 4).

At time CLK6, AND gate 309 resets latch 303, which turns off Message I in the display area of operator panel 131. Latch 310 has already turned on Message II in display area 132 of operator panel 131, asking the operator how many sheets N each set of originals to be collated comprises. This can be displayed, e.g., by a light showing "Pages?". Now, the operator has two choices. His first choice is to select the number N of originals or sheets in the set by keying in this number N, to the control panel data display and then pressing START switch 371. This will effect the storing of the displayed number N in register REG N. This is done by output signal REG N←REG D from AND gate 314 at time CLK0, when the start button has been pressed a second time.

The other choice of the operator is not to select any number N. Then, N=0 is displayed and will be stored in register REG N. In this case, the collator will execute a normal, nonadaptive collator function without grouping actual bins together as virtual bins.

Either way, the operator has to press the start button, thus effecting the storing of the number N, which is either 0 or the selected number, into register REG N.

Now, the machine logic determines from the numbers given by the collator design and the numbers inputted by the operator which grouping pattern of the actual bins into virtual bins fulfills the requirements. This will be explained in detail below with regard to FIGS. 6F, 6G and 6H.

As shown in the next decision block in FIG. 2A, a test is conducted to determine if the number N of originals or sheets in each set is larger than the sheet capacity L of a single actual bin. In FIG. 5, this is done by the processor comparing the content of register REG N with the constant L and controlling the state of the output registers 507 output signal $N>L$ appropriately. If N is not larger than L, register REG J is set to constant 1 and register REG H is set to the smaller of constant K and number M by the processor. In FIG. 3B, the function is initiated at time CLK1 by the dual purpose output of AND gate 313 designated REG $J\leftarrow 1$; REG $H\leftarrow$(K or M). In other words, each actual bin will be used as a virtual bin, $J=1$, which means that the number H of accessed virtual bins equals either the number K of actual bins in the collator ($H=K$) or the number M ($H=M$) if M is less than K.

If, on the other hand, the content of register REG N is larger than the constant L, register REG J is set to the closest integer complying with the relation $J\geqq N/L$. This function is initiated by output signal REG $J\leftarrow(\geqq N/L)$ of AND gate 315 at time CLK1. In other words, if N is larger than L, the number J of actual bins per single virtual bin is determined by $J\geqq N/L$. This ensures that the size of each virtual bin is sufficient to accept a complete set of N sheets.

Now, the number of virtual bins in the collator has to be determined. This is initiated by the output of AND gate 316 at time CLK2. The processor sets register REG H to the closest integer complying with the relation $H\leqq K/J$. Because $H\cdot J\leqq K$ (the collator has only k actual bins), $H\leqq K\cdot L/N$ is true. This defines a limit for the number of virtual bins in a given job.

The following numbers shall exemplify this. Assume a given collator has $K=20$ actual bins, each with a sheet capacity $L=30$. After the operator selected either the COPCOL or the COLLO mode by pressing pushbutton 361 or 362 (FIG. 3C) and selected $M=8$ and $N=35$, i.e., eight copies to be made from a thirty-five page document, the logic described determines the following. Because $N=35$ is definitely larger than $L=30$, the number J of actual bins per single virtual bin has to be determined according to $J\geqq N/L=35/30$. Because J can only take integers, $J=2$ will be chosen. The number Q of virtual bins available is now determined according to $Q\leqq K/J=20/2=10$. Thus, for the given job, 10 virtual bins are available each consisting of two actual bins. Since the number M is less than Q for this job, H will be set equal to M ($M=8$) as shown in FIG. 2A (right branch), otherwise H would be set to Q.

If, on the other hand, the number N of sheets per set is not larger than the sheet capacity L of each actual bin, each actual bin may be said to form one virtual bin, $J=1$. This means that the total number Q of virtual bins available equals the total number K of actual bins in the collator, $Q=K$. The number H of virtual bins actually used will be set to Q unless the number M is less than Q, in which case the number H will be set to M as shown in FIG. 2A (left branch).

FIG. 2B

Next, the logic senses which of the two modes the operator selected, the COPCOL mode, wherein copier and collator are used, or the COLLO mode, which means that a collate only job has to be executed, as explained below. If the COLLO mode is not selected, the COPCOL mode must be selected and AND gate 317, at time CLK5, outputs the signal STARTMACH. This requires that the duplex mode is not selected. If the duplex mode is selected, the flow chart branches to point C (FIG. 2C), as explained below.

Now it is checked if the content of register REG M is larger than the content of register REG H. If this is true, i.e., the number M of copies desired per original or of sets to be collated is larger than the number H virtual bins selected, the "collate overflow to tray 114" (COL 114) mode is enabled. Duplex tray 114 is shown in FIG. 1. Paper is guided into said tray via paper path 119 if duplex vane 120 is selected. The mode will be named COL 114 mode. AND gate 318 outputs an appropriate signal SET COL114 which sets latch 319 in FIG. 3A. The output signal of this latch effects the copier control 400 shown in detail in FIG. 4 to execute the COL 114 mode.

If the duplex mode of the copier/collator is selected, duplex tray 114 cannot be used for collation, because it is occupied during the copy production. Then the overflow copies are gated to exit pocket 123, i.e., the "exit pocket overflow" (EPO) mode is executed. Then, the flow chart branches to point C in FIG. 2C. If the duplex mode is not selected and the content of register REG M is not larger than the content of register REG H, there will be no overflow because all copies can be collated in the collator. Then, the above-described overflow or COL 114 mode is not necessary. As shown in FIG. 2B, Message II which asked for the number of originals N in the set can be turned off now. This is accomplished at time CLK6 by AND gate 312 and latch 310. In FIG. 3A, via OR gate 320, the copier control 400 now starts the machine and completes the copy run or job. After completion of the job, Message III is turned on by the run completion pulse, RUNOVER. This is accomplished by latch 322 in FIG. 3A which delivers output signal MSGIII. Message III asks the operator from latch 322 to empty the collator. This could be done by a signal light labeled "Empty Collator!".

A switch or a conventional sensor device associated with the collator bins can be used to detect if the collator has been emptied. The next decision block in FIG. 2B checks if the collator has been emptied. When the collator is emptied, the appropriate signal is inputted from the collator empty switch 391 in FIG. 3F which at time CLK0 via AND gate 392 sets latch 393 which in turn delivers signal COLEMPTY. Latch 393 is reset at time CLK7. AND gate 394 and latch 395 ensure that the output of latch 393 pulses only once per actuation of the collator empty switch. This circuit (FIG. 3F) is identical in design with the start switch circuit (FIG. 3D) described above. If the COLEMPTY signal which is generated by the collator empty switch COLEMTSW (FIG. 3F) is pulsed, Message III is turned off. This is accomplished in FIG. 3A as AND gate 323 enables AND gate 325 at time CLK6 to reset latch 322. AND gate 324 resets at time CLK0 the copier control circuits. Message III is turned off and the job is now completed.

If the number M of copies or sets is larger than the number H of virtual bins defined, the collation with overflow mode COL 114 has been started. Then, the decision block "COL 114 mode on?" in FIG. 2B is left by its YES exit. Latch 330 (FIG. 3A) is set by the output of AND gate 327, SETMSGIV, at time CLK0 with additional appropriate enabling signals, resulting in output signal MSGIV. Message IV indicates to the operator that a stack is in the overflow, i.e., duplex, tray 114 (FIG. 1) and that the operator has to press the start button to execute collation of this stack of uncollated sheets. The display may read, for example "Stack in Duplex-Press Start".

The following arithmetic operations are now conducted. The content of register REG N is diminished by the content of register REG H. In the same manner, the old content of register REG M is diminished by the content of register REG H. In FIG. 3A, these two operations are initiated by the output of AND gate 327 REG N←(REN N-REG H) and REG M←(REG M-REG H) and performed by the processor 501 (FIG. 5).

Then, Message III is turned off via AND gate 325 and latch 322 at time CLK6. After pressing of the start button 371 (FIG. 3D), AND gate 333 delivers signal SET COLLO. This resets latch 319 disabling the COL 114 mode through OR gate 334. Via latch 335, the COLLO mode is enabled by the copier control, shown in detail in FIG. 4. Following that, Message IV is turned off via AND gate 336 at time CLK6 as latch 330 is reset. Latch 337 has now been set through OR gate 348 resulting in an output signal MSGV which means that Message V is displayed. Message V indicates that the machine is in the collate only mode, i.e., the defined COLLO mode in which the copier function of the copier/collator remains unused. If the COLLO mode was selected originally, the first decision block in FIG. 2B leads directly to the setting of latch 337 in FIG. 3A) as a result of the signal STARTMACH(3) from the output of AND gate 328 FIG. 3B) through or gate 348.

FIG. 2C

After Message V is switched on via latch 337, the first decision block of FIG. 2C checks if the content of register REG N is larger than constant L. That means the logic checks if the number N of sheets per set is larger than the sheet capacity L per bin. If $N>L$ the number J of actual bins per virtual bin is again selected according to the above discussed equation: $J \geqq N/L$. Practically, register REG J is set to the closest integer complying with the relation $J \geqq N/L$. Then, the number of virtual bins available is selected according to $Q \leqq K/J$, i.e., register REG Q is set to the next integer complying with $Q \leqq K/J$. The number H of virtual bins actually used is then set to the lesser of Q or M. In FIG. 2C, this discussion concerned the YES branch of the first decision block.

The NO branch of the first decision block of FIG. 2C is used if the number N of sheets per set equals or is smaller than the sheet capacity L per actual bin, i.e., REG N is less than L. Then, the same selection as above shown in FIG. 2A, for the case "$N>L$"=NO, is made again. Register REG J is set to 1 and register REG H is set to the minimum of K or REG M. In FIG. 3B, this is initiated by the signal $N>L$ entering inverter 306, the output of which enables at time CLK1 AND gate 313.

The following decision, made in sequence (as shown in FIG. 2C) and also after either the COLLO or DUPLEX mode is selected (FIG. 2B), checks if the content of register REG M is larger than the content of register REG H. If this is true, the YES exit of the decision block leads to a block labeled enable "Exit Pocket Overflow Mode" (EPO). This EPO mode has to be executed as soon as the number of sheets stacked in the duplex tray 114 (FIG. 1A) exceeds the number of virtual bins in the collator 125. That means, the number M of sets to be collated exceeds the number H of virtual bins. The thus existing overflow cannot be fed into the duplex tray 114 again, instead it is transported to exit pocket 123 of the copier/collator. AND gate 338 in FIG. 3A, at time CLK3 sets latch 339 which delivers output signal "EPO" to copier control 400 which controls the execution of the EPO mode. The following decision block in this line in FIG. 2C checks if the run is complete. Upon completion, Message III, asking the operator to empty the collator is displayed as the RUN-OVER signal sets latch 322 in FIG. 3A. Additionally, Message VI is turned on, asking the operator to transfer (manually) the copies stacked in the exit pocket 123 (FIG. 1A) into the duplex tray 114 and to press the start button again. The message may say: "Transfer EPO to Duplex and Start!". In FIG. 3A, this is initiated by setting latch 342 via AND gate 341. The operator now has to empty the collator which is checked by the following decision block in FIG. 2C. If the collator is emptied ("COL EMPTY" in FIGS. 3A and 3F), Message III asking to empty the collator is turned off. This is accomplished by AND gates 323 and 325 resetting latch 322 in FIG. 3A.

Now, the machine conducts the following checks. Is the exit pocket 123 (FIG. 1A) empty? Is the duplex (AUX) tray 114 not empty? Is the start button pressed? In FIG. 3A, if all three questions can be answered positively, Message VI is at time CLK6. At time CLK0, AND gate 345 causes, by means of output signal REG M←(REG M-REG H), the content of register REG M to be diminished by the content of register REG H by the processor. Then, copier control 400 by the output signal of AND gate 345 via OR gate 320 starts the machine again. The loop back to point C in FIG. 2C indicates this function.

If, on the other hand, the second decision in FIG. 2C is NO, i.e., if the content of register of REG M is not larger than the content of REG H, the EPO mode is disabled. This is effected by AND gate 346 resetting latch 399 at time CLK3 in FIG. 3A. Then, the logic checks if the run has been completed and, upon completion, turns on Message III, thus indicating to the operator that the collator has to be emptied. This is accomplished by an output pulse from copier control 400 setting latch 322 in FIG. 3A. When the collator is emptied, the signal COLEMPTY (FIGS. 3A and 3F) pulses an input of AND gate 323 and Messages III and V are switched off, accomplished by AND gate 325 resetting latch 322 and AND gate 340 resetting latch 337. At time CLK0 AND gate 324 is enabled resetting copier control 400. This completes the job.

It shall be mentioned that input signal EP ONLY P and the EXIT POCKET ONLY mode are only activated when the copier is in the duplex mode with an odd number of originals. This function will be discussed in connection with FIGS. 6J and 6K.

SUMMARY OF OPERATION-FIGS. 3A-3F

Generally speaking, several cases can be distinguished depending on the number N of sheets per set and the number M of copies or sets to be collated in relation to the sheet capacity L of each actual bin of the collator and the number K of actual bins in the collator.

(1) Virtual Bins Not Required

If the number N of sheets per set does not exceed the sheet capacity L per actual bin, and also the number M of copies per original or number of sets to be collated does not exceed the number K of actual bins in the collator ($N \leqq L$ and $M \leqq K$) a normal collation job will be executed. Any grouping of any actual into virtual bins is obviously unnecessary.

(2) Virtual Bins Defined

A. No Overflow

If the number N of sheets per set exceeds the sheet capacity L per actual bin ($N > L$) then virtual bins have to be formed. The number H of virtual bins to be formed is determined by the required sheet capacity of each virtual bin. If the number M of copies or sets to be collated does not exceed this number H of defined virtual bins, virtual collation without overflow can be executed.

B. Overflow Into Internal Tray

If, as above, the number N of sheets per set exceeds the sheet capacity L of each actual bin, $N > L$, and at the same time, the number M of copies or sets to be collated is larger than the number H of virtual bins defined, $M > H$, then the number of copies or sheets in excess of the total collator capacity has to be handled. This requires obviously some kind of overflow receptacle. The invention shows ways to collate even these excessive sheets or copies into the collator. If a duplex copier is used for producing simplex copies, the copies produced in excess of the collator capacity (including the virtual bin concept described above) can be stored in the internal duplex receptable of the copier. In a second run, following the first copy/collation run the copy production portion of the copier/collator can be turned off. Then, the excess copies from the duplex receptacle or tray can be "flushed" into the paper path and collated into the collator. In the above specification this is labeled the COL 114 mode. In many cases, the second run will collate all excess copies, thus duplicating the active collator capacity.

C. Overflow Into External Pocket-Simplex

If the number of excess copies stored in the duplex tray exceeds the total capacity of the collator for this second run, the still excessive copies have to be fed to a second receptacle besides the duplex tray. The copier/-collator shown in FIG. 1A includes an external exit pocket which can be used to receive the excessive sheets of the second run. After the run is completed, the stack of sheets in the exit pocket can be transferred manually into the duplex tray and the collation job executed again. Assuming that the duplex tray and the exit pocket are of sufficient size, this procedure can be executed several times. It allows the collation of very large jobs by multiple use of a single limited collator through internal machine intelligence.

D. Overflow Into External Pocket-Duplex

If, under the same conditions, $N > L$ and $M > H$, duplex copies have to be produced from an original set, the duplex receptacle is occupied and cannot be utilized to store any overflow. In this case or in the case of a copier without duplex tray, the above-mentioned exit pocket serves to receive those copies which cannot be collated in a first run. The second run, as above, requires the operator to retransport the copies stacked in the exit pocket into the duplex tray which is now empty. Collation can now be executed. As explained above, this procedure can be utilized several times, thus expanding the active collator capacity.

(3) Collation Impractical

The last case is of trivial nature. It concerns a job in which the number N of sheets per set is larger than the total capacity of the collator, $N > L \cdot K$. Totally independent of the number M of copies or sets to be collated, this job does not allow a meaningful collation under the given conditions.

FIG. 4

FIG. 4 shows the copier control circuits which were already mentioned and shown in FIGS. 1B and 3A. A conventional base copier logic 401 controls the different xerographic processing stations of the copier portion of the copier/collator of FIG. 1A. The "device control outputs" of base copier logic 401, via AND gates 407–412, control charge corona 107, erase arrangement 108, developing station 109, transfer station 111, optics system 104, and fuser roll 117. The AND gates 407–412 are disabled by the signal COLLOMOD (FIG. 3A) which is inverted by inverter 406. This means that in the collate only mode of the copier/collator the defined xerographic processing stations are disabled.

Furthermore, base copier logic 401, via AND gate 417 and OR gate 418, controls duplex vane 120 upon an appropriate signal COL 114 (FIG. 3A) which, via inverter 416, forms another input of AND gate 417. Duplex vane 120, as detailed above in connection with FIG. 1A, directs the produced copy either along paper path 119 into duplex tray 114 or, in its other position, via paper path 118 towards exit vane 122. The exit vane 122 is controlled by base copier logic 401 also (signal: EXIT VANE). AND gate 419 and OR gate 420 supply an exit vane control signal from base copier logic 401. Signal EPO which defines the exit pocket mode (FIG. 3A), inverted by inverter 415 forms the second input into AND gate 419. AND gates 413 and 414 receive their second input from comparator 402 which compares the contents of register REG H (FIG. 5) with the copy count delivered from base copier logic 401. Register REG H as detailed above contains the number of accessed virtual bins formed in the collator. Comparator 402 delivers an output signal when the copy count from base copier logic 401 equals or is larger than the content of register REG H which stores the number H of virtual bins.

The three input signals COLLOMOD, COL 114, and EPO initiate the collate mode in base copier logic 401 via OR gate 404. Other inputs into base copier logic 401 are derived from the start button (FIG. 1A) which delivers a start signal, and from the stop/clear button (FIG. 1A) via OR gate 403 delivering a zero display signal. Further inputs into OR gate 403 are derived from FIG. 3B in the form of the signals ZERODISP. Additionally, base copier logic 401 receives a reset signal initiating a complete reset of all functions.

Outputs of base copier logic 401 include the already mentioned device control and copy count outputs. If the duplex mode is selected, a signal DUPLEX is delivered to AND gate 421 and from there to the copier/collator. The motor output starts a single shot 405 which delivers a pulse signal RUNOVER to the logic circuits in FIG. 3A. Additionally, base copier logic 401 delivers to the input registers 508 shown in FIG. 5 an input for register REG D regarding the number displayed in message display area 132 on operator panel 131.

Input signals EPONLY from FIG. 3A and BYPASS from FIG. 5 are used only when the copier is in the duplex mode and an odd number N of originals has to be copied, as addressed above. This function, which effects the exit, duplex and turnover vanes, is discussed below in connection with FIGS. 6J and 6K.

FIG. 5

FIG. 5 shows the system configuration of processor system 501, preferably a microcomputer of conventional type. As shown in FIG. 1B, the processor system configuration cooperates with the logic circuits, FIGS. 3A–3E, the copier control circuits of FIG. 4, and the collator of FIG. 1A. The system configuration of FIG. 5 shows that processor 501 receives clock pulses from a processor clock 502. A control storage 503, provides programs of instructions and, via a data bus, data signals to processor 501. Output registers 507, input registers 508, and working memory 509 are accessed on processor command. Working memory 509 preferably is a random access memory (RAM). The processor 501 accesses the control storage via the data bus and the address bus which, through address decoders 504, 505, and 506, addresses registers 507 and 508 and working memory 509.

Output registers 507 deliver several outputs to the logic circuits, the copier control circuits and the collator as shown in FIG. 1B. Comparator 402 of the copier control circuits receives the content of register REG H. The control circuits in FIGS. 3A and 3B receive the three signals EPONLYP, N>L and M>H. Collator 125 obtains the signal INDEXSOL which activates the indexing solenoid switching movable deflector 126 (FIG. 1A) to the next bin 127, and the signal RETSOL which activates the return solenoid moving deflector 126 from any position back to the entrance of the first bin 127.

Input registers 508 receive an input from the display register in base copier logic 401 and the signals DUPLEX and EXIT VANE in FIG. 4. From the collator (FIG. 1A), input registers 508 obtain the signals BIN1SW, INDEXSW, and DEFPAPSW. The first signal, BIN1SW, is derived from the bin number one switch mentioned above which outputs this signal as soon as deflector 126 is opposite the first collator bin 127. The second signal, INDEXSW, is obtained from the deflector index switch which indicates when movable deflector 126 is opposite any bin 127. The third signal, DEFPAPSW, is obtained from the deflector paper switch which is included in the paper path of movable deflector 126. This signal is on as long as a sheet of paper is fed through the deflector and is turned off when the sheet has entered the selected collator bin.

The next eight signals in FIG. 5 entering input registers 508 are derived from the logic circuits in FIGS. 3A and 3B. The meaning of these signals may be obtained from the preceding discussion of FIGS. 3A and 3B.

Finally, working memory 509 contains a number of registers, most of which have been named and their function discussed already above. The registers are:

REG P which counts the originals during copying (input from base copier logic 401);

REG D which contains the number displayed on the operator panel 131;

REG M which contains the number M of copies desired per original;

REG J storing the number J of actual bins per single virtual bin;

REG H which includes the number H of virtual bins to be accessed;

REG Q whose content shows the number of virtual bins available;

REG N storing the number N of originals; and

REG X and REG Y are intermediate buffer registers necessary to execute the functions in the program implementation below.

A further register REG INDEXLIM in working memory 509 controls movable deflector motion and stores a number showing how many times the deflector has to be incremented to either reach the first non-full actual bin within the next successive virtual bin, or to reach the first non-full actual bin within virtual bin number one following return of the deflector.

Additionally, working memory 509 contains four counter registers. Return bin counter RETBINCNT shows a number determining into which actual bin of the first virtual bin sheets shall be fed after the deflector returned into its initial position. In other words, it defines how many actual bins are already full. The sheet counter SHEETCNT monitors the number of sheets that are contained within each non-full actual bin. The index counter INDEXCNT counts the number of pulses derived from the index switch of the collator to determine the position of the deflector with regard to the collator bins. Finally, the virtual bin counter VBINCNT counts the virtual bins that have been supplied with sheets to be collated. Working memory 509 also contains a number of control bits or flags necessary in execution of the processor controlled functions. More details about function and relationship of registers, counters and control flags in the working memory 509 will be apparent from the detailed description of the program segments in FIGS. 6A–6H below.

FIGS. 6A–6L

Figure 6A:
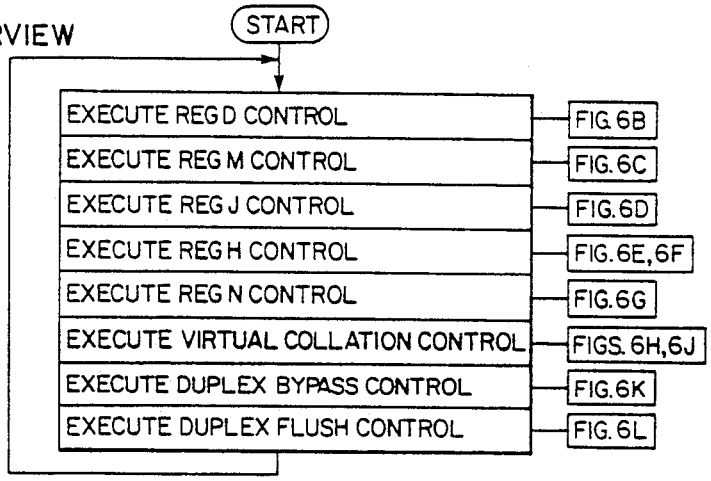

FIG. 6A shows the program overview and the order of execution of the smaller program segments. The program segments are executed in the following order: register REG D control, register REG M control, register REG J control, register REG H control, register REG N control, virtual collation control, duplex bypass control and finally duplex flush control. The program then loops back to START and continuously re-executes all program segments. These program segments are flow-charted with microcode listing in a microcode assembly language in FIGS. 6B–6H. Microcode listings shown are specific for the specific processor, described in U.S. Pat. No. 4,123,155 and in Ser. No. 768,651, filed Feb. 14, 1977, entitled "Copy Production Machines", previously referenced. Anyone skilled in the art will readily implement the functions described on any suitable processor system.

Figure 6B:
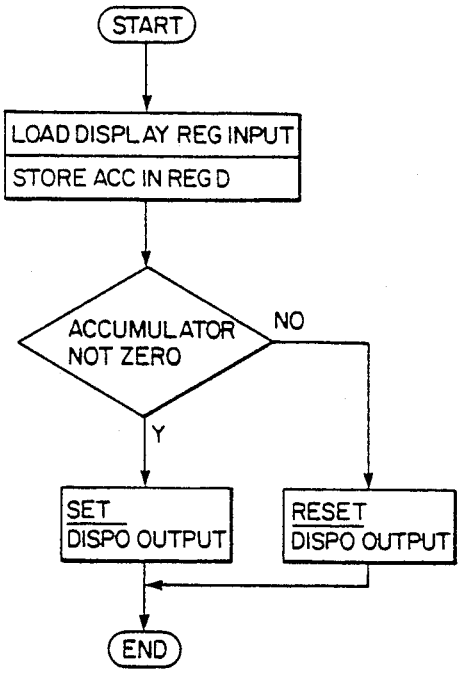

FIG. 6B represents the details of the program segment for register REG D control. This program reads the contents of the copier display register (base copier logic 401) and stores this number in register REG D of the working memory 509. This register may be easily accessed by other portions of the program. The program continues and sets the $\overline{\text{DISP0}}$ output if the number stored in REG D was non-zero, otherwise said output is reset. Microcode is shown to implement the desired function.

Figure 6C:
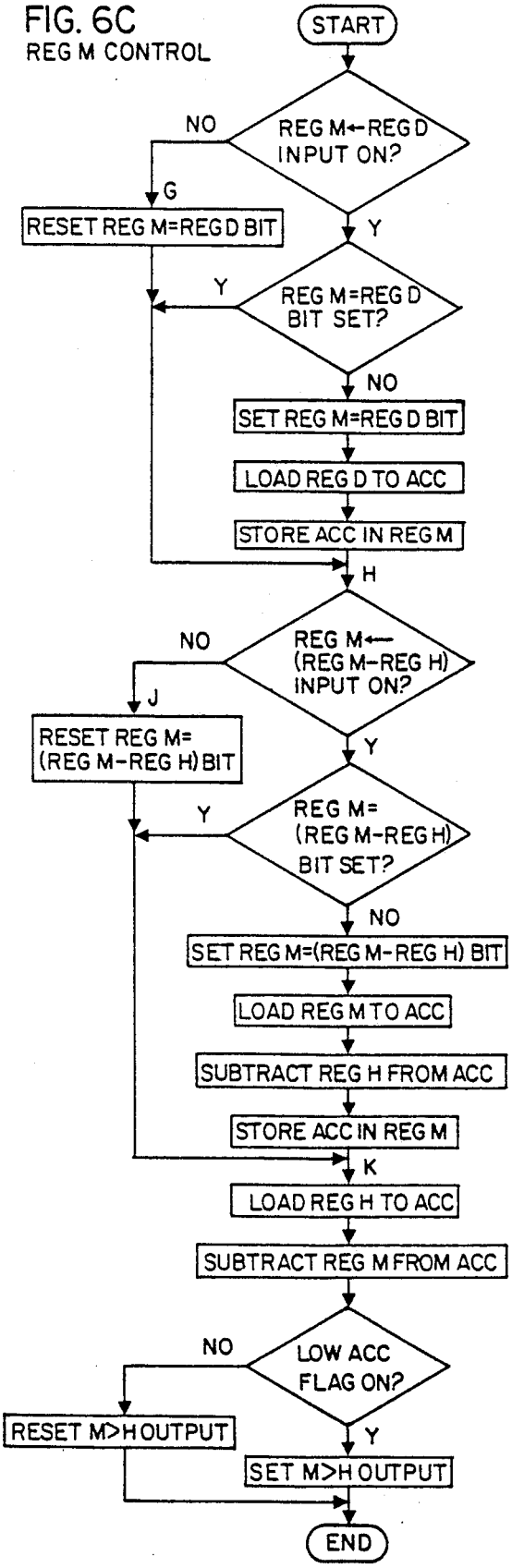

FIG. 6C shows the details of the program segment for register REG M control. Register REG M control has three functions. The first function is to store the contents of register REG D into register REG M when the leading edge of input signal REG M←REG D (FIG. 3B) is detected. If the REG M←REG D input is on and the REG M=REG D control bit is off, the program sets the REG M=REG D bit. The REG M=REG D bit ensures that the function of this portion of the program is executed only once at the leading edge of the input signal. The program continues by loading register REG D to the accumulator and then storing the accumulator into register REG M. If the REG M←REG D input had been off, then the REG M=REG D bit would have been reset with the program branching to the next step.

The second function of register REG M control is to subtract register REG H from register REG M and store the result in register REG M if the appropriate input is on. Looking at the flow chart at point H, if the REG M←(REG M−REG H) input is on and the REG M=(REG M−REG H) bit is off, the program sets the REG M=(REG M−REG H) bit. Now register REG M is loaded to the accumulator and register REG H is subtracted from the accumulator. The accumulator is now stored in register REG M. Again, the REG M=(REG M−REG H) bit is used to ensure that this function is executed only one time at the leading edge of the appropriate input signal.

The third function of register REG M control is to determine whether or not the content of register REG M is greater than that of register REG H. Starting at position K, register REG H is loaded into the accumulator and register REG M is then subtracted from the accumulator. If register REG M is greater than register REG H, the low accumulator flag internal to the processor will be set. If it is set, then the program turns on the M>H output (FIGS. 3A and 3B). If the low accumulator flag was not on, then the program resets the M>H output.

Figure 6D:
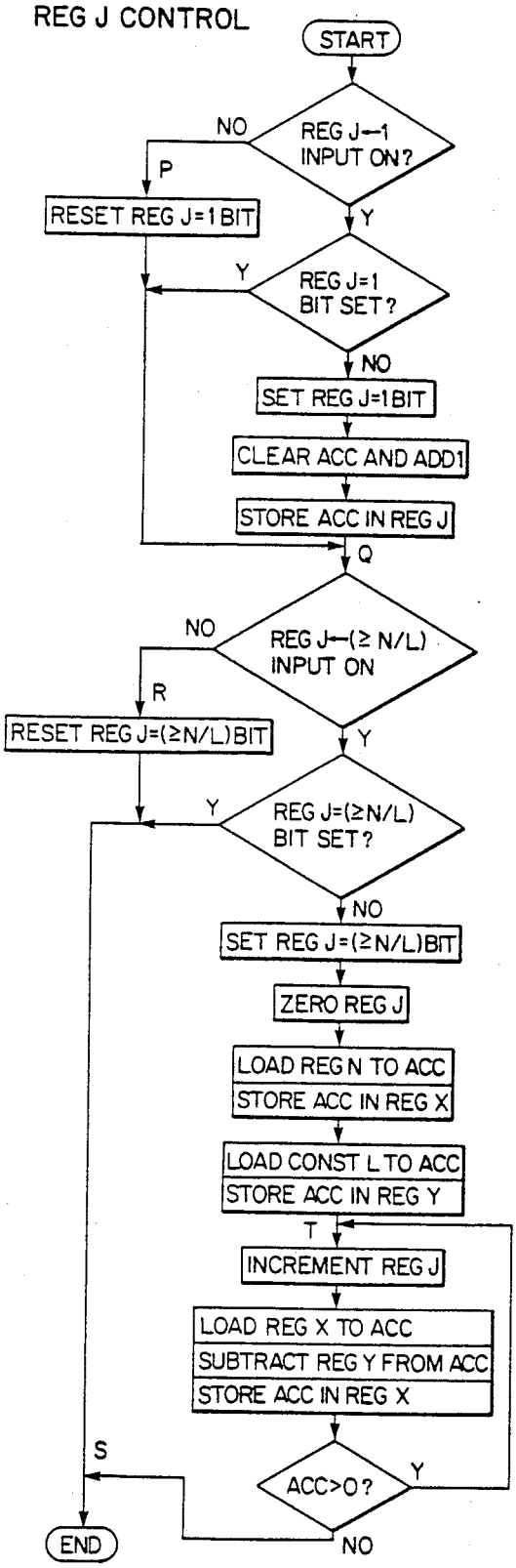

FIG. 6D shows the details of the program segment for register REG J control. This program segment has two functions. The first function is to load the number "1" into register REG J. Beginning at START in the flow chart, if the REG J←1 input is on and the REG J=1 bit is off, then the REG J=1 is set showing that this part of the program has been executed. Then the accumulator is cleared and one is added to the accumulator. The accumulator is then stored in register REG J. Back up at START, if the REG J←1 input is off, then the REG J=1 bit is reset.

The second function of register REG J control is to store a number in register REG J such that the number is greater than or equal to register REG N divided by constant L. Beginning at point Q on the flow chart, if the REG J←(≧N/L) input is on and the REG J=(≧N/L) bit is off then the program sets the REG J=(≧N/L) bit. A zero is stored in register REG J and register REG N is loaded to the accumulator. The accumulator is now stored in register REG X which is an intermediate buffer register used temporarily in the program. Constant L is loaded to the accumulator and the accumulator is then stored in register REG Y which is another buffer register. At point T, the program enters a loop which increments register REG J and then loads register REG X to the accumulator. Register REG Y is subtracted from the accumulator and the result is stored in register REG X. If the accumulator is now less than zero, register REG J now contains the desired number. If the accumulator is greater than zero the desired number has not been generated, in which case the program loops back to point T and register REG J is again incremented, register REG X is loaded to the accumulator, and register REG Y is subtracted from the accumulator and stored in register REG X. This loop is continued until the accumulator is not greater than zero. Thus, this loop in the program counts how many times the constant L must be subtracted from the value of register REG N to achieve a result less than zero. This count will be the desired content of register REG J such that register REG J is greater than or equal to the content of register REG N divided by L.

Figure 6E:
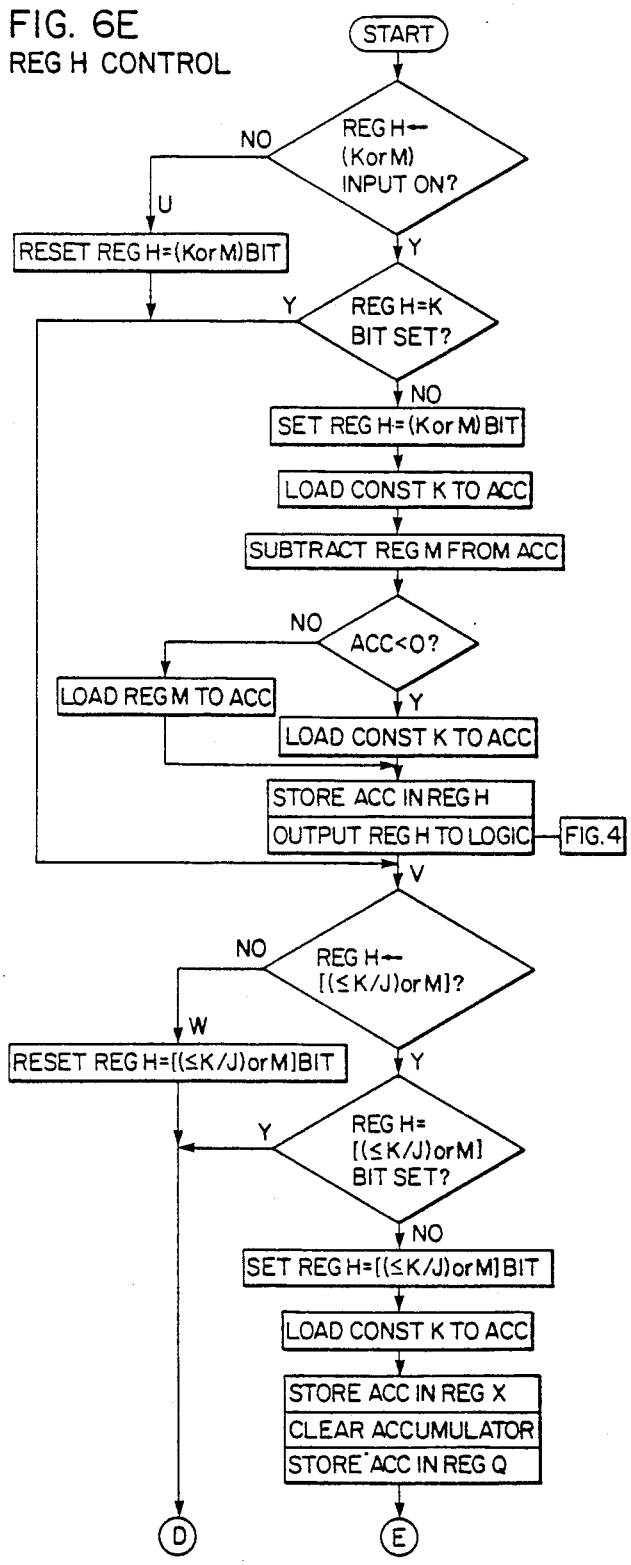
Figure 6F:
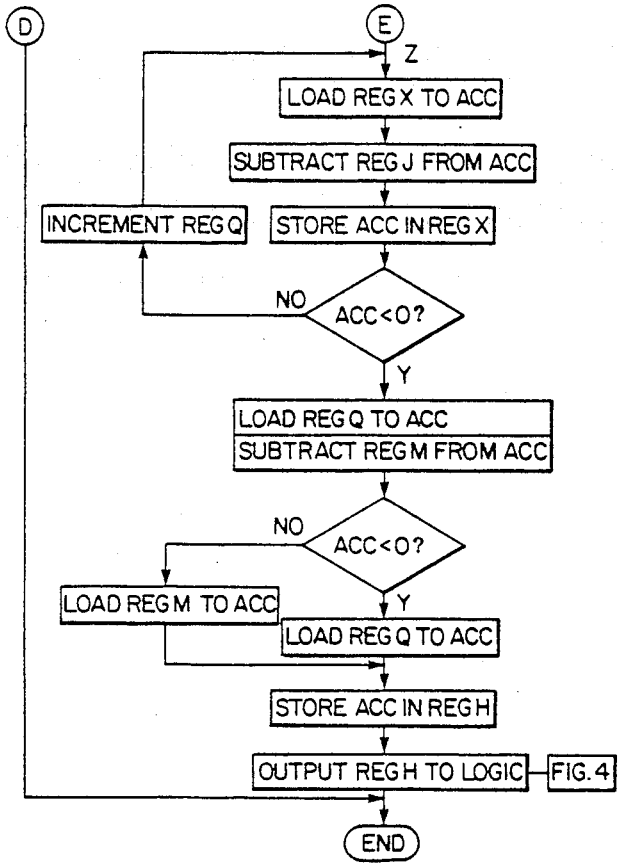

FIGS. 6E and 6F show the details of the program segment for register REG H control. This program segment has two functions. The first function is to load the minimum of constant K or REG M into register REG H in the working storage. Beginning at the top of the flow chart, if the REG H←(K or M) input is on and the REG H=(K or M) bit is off, then the program sets the REG H=(K or M) bit and loads constant K to the accumulator. REG M is subtracted from the accumulator. If the result is less than zero (REG M>K) then constant K is again loaded to the accumulator, otherwise REG M is loaded. The accumulator is then stored in register REG H. Since the value of register REG H is needed in the hardware logic (FIG. 4), this number is output through output registers 507. If the REG H←(K or M) input is off then the REG H=(K or M) bit is reset. This ensures that this portion of the program is executed only on the leading edge of the REG H←(K or M) input signal.

The second function of register REG H control is to store a number in register REG Q such that register REG Q is less than or equal to the constant K divided by the content of register REG J. Then the minimum of REG Q and REG M is stored in REG H. Beginning at point V in the program if the REG H=[(≦K/J) or M] input is on and the register REG H=[(≦K/J) or M] bit is off, then that bit is set. The constant K is loaded into the accumulator. The accumulator is stored in register REG X. Thus, the accumulator is cleared and the content stored into register REG Q. Now at point Z on the flow chart register REG X is loaded to the accumulator and register REG J is subtracted from the accumulator and the result is stored in register REG X. If the accumulator is now less than zero, then the desired number is in register REG Q. If the accumulator is not less than zero then register REG Q is incremented and the program loops back to point Z. Register REG X is loaded to the accumulator and J is subtracted from the accumulator and stored in register REG X and this process of subtracting register REG J from register REG X is continued and counted until the accumulator is less than zero. At this time, register REG Q contains the desired number. This loop subtracts the content of register REG J from the constant K until the result is less than zero. The number of times the subtraction operation is done is counted and stored in register REG Q. Register REG Q then contains the desired number once this loop is completed. Now REG Q is loaded to the accumulator, REG M is subtracted from the accumulator. If the result is less than zero, then REG Q is loaded again to the accumulator, otherwise REG M is loaded. The accumulator is then stored in REG H, and the value of REG H is output through output registers 507 to the logic circuits.

Figure 6G:
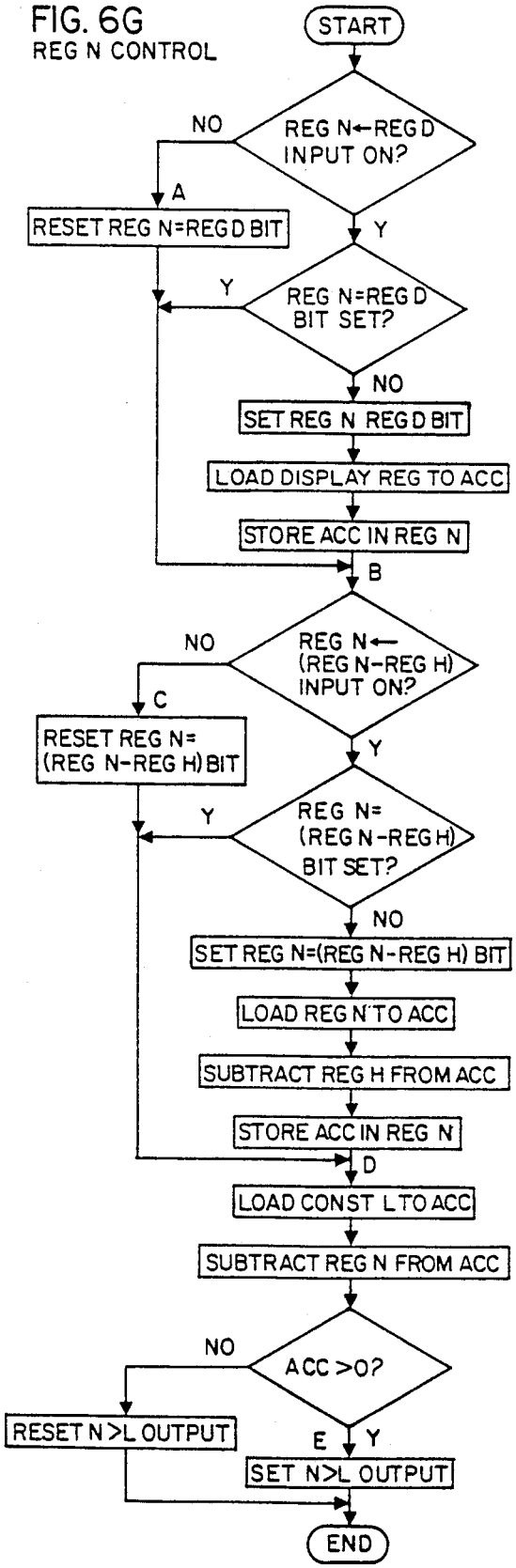

FIG. 6G shows the details of the program segment for register REG N control. Register REG N control has three functions. The first function is to store the content of register REG D into register REG N. Beginning at the top of the flow chart, if the REG N←REG D input is on and the REG N=REG D bit is off, then the REG N=REG D bit is set. The display register REG D is then loaded to the accumulator. The accumulator is stored in register REG N. If the REG N←REG D input is off, the program resets the REG N=REG D bit ensuring that this portion of the program is executed only on the leading edge of the REG N←REG D input signal.

The second function of register REG N control is to subtract register REG H from register REG N and store the results in register REG N. Beginning at point B on the flow chart, if the REG N←(REG N−REG H) input is on, and the REG N=(REG N−REG H) bit is off, then the program sets this bit. Register REG N is loaded to the accumulator and register REG H is subtracted from the accumulator. The result is stored in register REG N. If the register REG N←(REG N−REG H) input is off, then the program resets the REG N=(REG N−REG H) bit, ensuring that this portion of the program is executed only on the leading edge of the REG N←(REG N−REG H) input signal.

The third function of register REG N control is to determine whether or not the content of register REG N is greater than the constant L and if so, to set the N>L output. Beginning at point D on the flow chart, first the constant L is loaded to the accumulator and the register REG N is subtracted from the accumulator. If the accumulator is less than zero, then the N>L output is set. Otherwise, the N>L output is reset by the program.

FIGS. 6H and 6J show the details of the program segment for virtual collation control. This part of the program controls the movement and position of movable deflector 126 in FIG. 1A. Beginning at the top of the flow chart, if the deflector paper switch in deflector 126 is off, and the deflector paper switch history bit in the working storage is on indicating that the trailing edge of the deflector switch has just been detected, i.e., that a sheet has just entered the collator bin, then the program continues at point BB. If the virtual bin count is not equal to H then deflector 126 is not in the last virtual bin and must now increment to the next virtual bin. Deflector 126 will increment J times where J is the number stored in register REG J. The program will now store register REG J in a working byte called REG INDEXLIM (FIG. 5), the virtual bin counter VBINCNT (FIG. 5) will be incremented, and the program continues to point DD. If the index count is not equal to the index limit, which in this case is J, then the deflector index solenoid is turned on by signal INDEXSOL (FIG. 5) causing deflector 126 to begin moving towards the next bin. Now, at point GG, the program will loop until the deflector index switch is off at which time the deflector index solenoid is turned off. Now the program will loop around point HH until the deflector index switch is on indicating that the collator deflector has arrived at the next bin, at which time the index counter byte (INDEXCNT) is incremented and the program loops back to point DD. The index count is compared to the index limit again and if the deflector has not incremented the proper number of bins, the program will continue in this loop until the index count is equal to the index limit. When these two numbers are equal, the program will zero the index counter and this will be the end of the program for this pass.

Returning now to point BB on the flow chart of FIG. 6H, if the trailing edge of the deflector switch signal was just detected and the virtual bin count (VBINCNT) is equal to H, this indicates that deflector 126 just fed a sheet into the last virtual bin and must now return to bin number 1, the first bin and increment to the first actual bin in the first virtual bin that has not yet been filled to capacity. The sheets per bin counter (SHEETCNT) is now incremented. This happens each time deflector 126 returns to the first virtual bin. The sheets per bin counter (SHEETCNT) shows how many sheets are in the active (non-full) actual bins within each virtual bin.

If the sheets per bin counter (SHEETCNT) is not equal to thirty, which is the defined capacity of each bin, the program branches to point EE where the deflector return solenoid (signal RETSOL in FIG. 5) is turned on. At point FF the program waits until deflector 126 reaches bin number one and turns on the bin number one switch. At this time the deflector return solenoid is turned off and the virtual bin counter is set to one. The return bin counter is now stored in the index limit. The return bin counter indicates the number of times the deflector must increment to reach the first actual bin in virtual bin number one that has not yet been filled to capacity. The program continues to point DD on FIG. 6H. This portion of the program was used previously to provide control of the increment of the deflector from one virtual bin to the next. Now since the index limit register REG INDEXLIM has been loaded with a different number, i.e., the content of the return bin counter RETBINCNT, this program segment will be used to increment deflector 126 to the first actual bin in virtual bin number one which has not yet been filled to capacity. Beginning at point DD the program will pulse the deflector index solenoid using output signal INDEXSOL and count these pulses using the index counter until the index counter is equal to the index limit, indicating that deflector 126 has arrived at the first actual bin in virtual bin number one which is not yet filled to capacity.

Figure 6K:
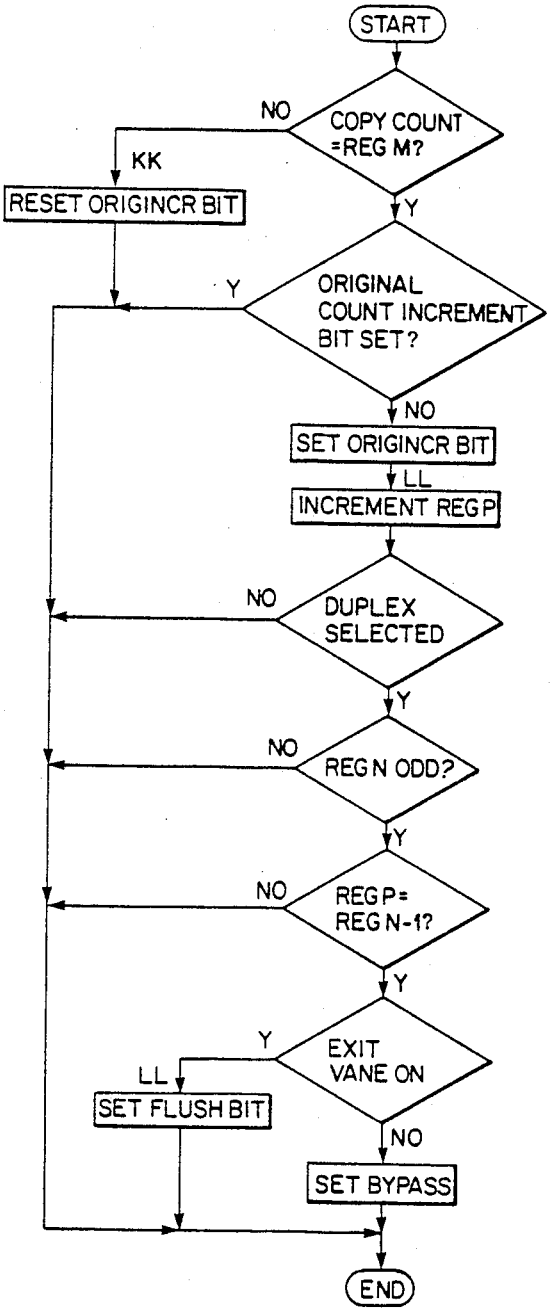

FIG. 6K shows the details of the program segment for duplex tray bypass. If the number N of originals is odd and duplex mode is selected, this program segment causes the copies of the last original to bypass duplex tray 114 if the copies are intended to enter the collator. If the copies are intended to be fed into the exit pocket, this program segment allows the copies to enter duplex tray 114 as usual and then initiates a duplex tray flush mode in which the copies are fed to the exit pocket through the copier in a paper feed only mode. This is similar to the collate only mode in which the xerographic process is inhibited. The duplex tray flush function is detailed in FIG. 6K, described below.

Beginning at the top of FIG. 6K, if register REG D which contains the copy count is equal to register REG M and if the original count register REG P has not already been incremented, then the ORIGINAL INCREMENT bit is set. This ensures that the originals count register REG P is incremented only once per original. At point LL on the flow chart, register REG P is incremented. If duplex is selected and the content of register REG N is an odd number, and REG P=REG N−1, indicating that the last original is being fed onto the document glass, and if signal EXIT VANE (FIG. 4) is off, indicating that copies are intended for the collator, the program sets the bypass output which turns off duplex vane 120 and turnover vane 124. If exit vane 122 is off, the FLUSH bit is set which will cause duplex tray 114 to be flushed after all copies are made of the last original. Going back to the top of FIG. 6K, if the contents of registers REG D and REG M are not equal then the ORIGINAL INCREMENT bit is reset. This ensures that register REG P is incremented only once per original.

Figure 6L:
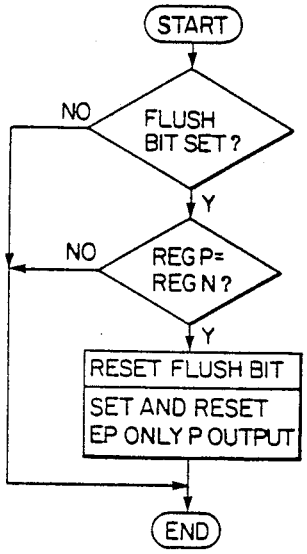

FIG. 6L shows the details of the program segment for the duplex tray flush function. This function is enabled after all copies of the last original have been made, if the number N of originals is odd, the duplex function is selected, and the copies are intended for exit pocket 123. After all copies of the last original have been fed into duplex tray 114, they are transported out of duplex tray 114 in an EPONLY mode through copier 101 to exit pocket 123. Beginning at the top of FIG. 6K, if the FLUSH bit is set and the contents of registers REG P and REG N are equal, REG P=REG N, indicating that all copies of the last original are completed and in duplex tray 114, the FLUSH bit is reset and output signal EPONLYP is pulsed by setting and resetting the output. This output causes the EPONLY latch 321 (FIG. 3A) to be set, restarts the machine via OR gate 320, and enables the hardware of FIGS. 3A and 3B to accomplish the duplex tray flush function.

While the invention has been described with reference to a preferred embodiment thereof, this is not to be construed or interpreted as to limit the claims which follow, but it will be understood that variations and modifications can be effected within the spirit and scope of the invention.

What is claimed is:

1. A method of operating a sheet collator to collate into actual bins sheet sets, comprising the steps of:

entering into a register the number of sheets contained in each sheet set, indicating the sheet capacity of each actual bin, inspecting said number entered in said register to produce a signal if it exceeds the indicated actual bin capacity, grouping a plurality of adjacent actual bins together into a virtual bin, upon the occurrence of said signal, such that the capacity of said virtual bin at least equals said entered number, and collating a complete sheet set into said virtual bin.

2. The method of operating a sheet collator as recited in claim 1, wherein said grouping step and said collating step further comprise:

grouping adjacent actual bins into a plurality of virtual bins, such that the capacity of each virtual bin at least equals said entered number, and collating complete sheet sets into said plurality of virtual bins.

3. The method of operating a sheet collator as recited in claim 2, further comprising the step of:

entering into a register the number of sheet sets.

4. A method of collating sequentially received sheets into sets placed in a selected one of a first sheet receiving means with actual bins, each of the actual bins having the same fixed sheet capacity, and second sheet receiving means, comprising the steps of:

registering the nunmber of sheet sets and the number of sheets contained in each sheet set, grouping said actual bins into a number of virtual bins, if said registered number of sheets exceeds said actual bin fixed sheet capacity, such that the capacity of each virtual bin at least equals said number of sheets contained in each sheet set, collating complete sheet sets into said virtual bins until the total number of received sheets exceeds the capacity of all the virtual bins, feeding the remaining sheets into the second sheet receiving means, removing said collated sheet sets from the bins, and collating said sheets from said second sheet receiving means into said virtual bins.

5. A method of operating a combined duplex copier/collator, when copying an original set of sheets, to collate the copy sets into bins each with a fixed capacity of sheets, comprising the steps of:

specifying the number of copies desired and the number of sheets contained in said original set, assigning sets of bins to a number of "virtual bins", if said specified number of sheets exceeds said fixed bin capacity, such that the capacity of each virtual bin at least equals said number of sheets in each original set, copying each original sheet the number of times specified for the number of copies desired, collating complete copy sets into said virtual bins, feeding excess copy sets into a duplex receptacle in the copier, removing said collated copy sets from the bins, disabling copy functions in the copier, and successively collating said copies stored in the duplex receptacle into the bins.

6. A multibin sheet collator, capable of collating sets having more sheets than each bin's capacity, comprising:

a plurality K of sheet receiving bins, each with a capacity of L sheets, transfer means, adjoining said bins, for transferring sheets into said bins in succession starting from a home position, a source of input signals indicating the number N of sheets to be collated into a set, a computer, connected to the transfer means, including a control storage, input means, and output means, said input means of said computer receiving said input signals, said output means of said computer connected to and controlling the transfer means to direct sheet feeding into the bins of the collator, and said control storage including a computer program which enables said computer to:

compare said number N of sheets to be collated into a set with the capacity L of each collator bin;

indicate, when said number N is greater than said capacity L, an integer J such that $J \geqq N/L$; and control the output means to direct sheet feeding successively into each Jth bin, counting from the home position, and providing collated sheet sets in adjacent bins by counting from succeeding positions as the Jth bins reach their capacity.

7. The multibin sheet collator of claim 6, further comprising:

an additional source of input signals indicating the number of sets to be collated, a receptacle, connected to and controlled by said computer output means, for receiving copies exceeding the capacity of all the utilized collator bins combined.

8. Apparatus for assembling collated sets of copies made from a supplied set of originals, including:

a fixed number of copy-receiving bins each capable of storing no more than a fixed number of copies;

a selectable variable number of copy-receiving bin-groups, each bin-group being constituted of a number of adjacent bins, each bin-group capable of storing a collated set of copies;

a first source for supplying first signals representing the number of originals in the supplied set;

control means associated with said bins and first source, operative to select the number of bin-groups as a function of the first signals from the first source.

9. The apparatus of claim 8, further including:

a second source for supplying second signals representing the number of sets of copies to be made.

10. The apparatus of claim 9, wherein:

there is provided a receptacle; and the control means is further operative, in response to said first and second signals and to the numbers of bins and bin-groups, to direct copies, in excess of the number storable in said bin-groups, to said receptacle.

11. A sheet collator for assembling a desired number of sets of copies from one set of originals, comprising:

a plurality of bins for receiving copies, each bin having a fixed capacity for holding a fixed number of copies forming a complete or partial set;

deflection means, adjacent said bins, for depositing in selected bins, in sequence, one copy at a time;

input means for indicating, as electrical signals, a quantity representative of the number of originals to be collated and a quantity representative of the desired number of sets of copies to be assembled;

logic means, conneced to said input means, registering as electrical signals a quantity representative of the capacity of each of said bins, and responsive to said signals and the signals from the input means for supplying an electrical output signal representative of the quantity, if any, by which the number of originals to be collated exceeds the number of copies which may be held by each bin;

control means, connected to said deflection and logic means, responsive to said logic output signal to cause said deflection means to repeatedly deposit copies into said bins, in sequence, skipping a number of bins during each repetition in accordance with the quantity by which the number of originals exceeds each bin's capacity and, when bins are filled to capacity, causing the deflection means to repeatedly deposit, in sequence, copies into bins adjacent the filled bins, to assemble sets of copies.

12. A sheet collator for assembling a desired number of sets of copies from one set of originals, comprising:

a plurality of bins for receiving copies, each bin having a fixed capacity for holding a fixed number of copies forming a complete or partial set;

deflection means, adjacent said bins, for depositing in selected bins, in sequence, one copy at a time;

input means for indicating, as electrical signals, a quantity representative of the number of originals to be collated and a quantity representative of the desired number of sets of copies to be assembled;

logic means, connected to said input means, registering as electrical signals a quantity representative of the capacity of each of said bins, and responsive to said signals and the signals from the input means for supplying an electrical output signal representative of the quantity, if any, by which the number of originals to be collated exceeds the number of copies which may be held by each bin;

control means, connected to said deflection and logic means, responsive to said logic output signal to cause said deflection means to repeatedly deposit copies into said bins, in sequence, skipping a number of bins during each repetition in accordance with the quantity by which the number of originals exceeds each bin's capacity and, when bins are filled to capacity, causing the deflection means to repeatedly deposit, in sequence, copies into bins adjacent the filled bins, to assemble sets of copies;

a receptacle, associated with said bins, for receiving copies exceeding in number the fixed capacity of all of said bins combined; and means for transferring the excess copies in said receptacle to the deflection means for further assembly into sets until the desired number of sets of copies are assembled;

13. A combination for copying a supplied set of originals and assembling collated sets of copies therefrom, including;

a copying apparatus selectably operable during set assembly;

a plurality of copy-receiving bins each capable of storing up to a defined quantity of copies;

means intermediate the bins and copying apparatus for directing copies from the copying apparatus to the bins;

a selectable number of copy-receiving bin-groups, each bin-group comprising a number of adjacent bins, each bin-group capable of storing a collated set of copies;

a source for supplying signals representing the number of originals in the set supplied to the copying apparatus;

first control means associated with said bins and source, operative to select said number of bin-groups as a function of the signals from the source;

an additional source for supplying additional signals representing the number of sets of copies to be made;

a receptacle;

second control means associated with said bins, receptacle and sources, operable in response to said first and second signals and to the numbers of bins and bin-groups, to direct copies, in excess of the quantity storable in said bin-groups, to said receptacle; and third control means, associated with said bins, receptacle, sources and copying apparatus, operable as a function of the additional signals to disable the copying operation while directing the excess copies from the receptacle to the bins to complete collation.

14. A method for copying a supplied set of originals and assembling collated sets of copies therefrom, including:

directing copies from a copier to a set of collator bins;

supplying signals representing the number of originals in the set supplied to the copying apparatus;

selecting subsets of bins as a function of the source signals;

supplying additional signals representing the number of sets of copies to be made;

directing copies, in excess of the capacity of subsets to a receptacle;

removing copies directed to the bins from the bins; and disabling copying while directing excess copies from the receptacle to the bins to complete collation.

* * * * *